US011471745B2

(12) United States Patent
Durocher et al.

(10) Patent No.: US 11,471,745 B2
(45) **Date of Patent: *Oct. 18, 2022**

(54) HELMET

(71) Applicant: BAUER HOCKEY, LLC, Exeter, NH (US)

(72) Inventors: Jacques Durocher, Saint-Jerome (CA); Marie-Claude Genereux, Sainte-Therese (CA)

(73) Assignee: BAUER HOCKEY, LLC, Exeter, NH (US)

( * ) Notice: Subject to any disclaimer, the term of this patent is extended or adjusted under 35 U.S.C. 154(b) by 162 days.

This patent is subject to a terminal disclaimer.

(21) Appl. No.: 16/906,824

(22) Filed: Jun. 19, 2020

(65) Prior Publication Data

US 2021/0038966 A1 Feb. 11, 2021

Related U.S. Application Data

(63) Continuation of application No. 15/270,623, filed on Sep. 20, 2016, now Pat. No. 10,722,777.

(Continued)

(51) Int. Cl.

*A42B 3/32* (2006.01)
*A63B 71/10* (2006.01)

(Continued)

(52) U.S. Cl.

CPC ..... *A63B 71/10* (2013.01); *A42B 3/324* (2013.01); *A63B 2102/14* (2015.10);

(Continued)

(58) Field of Classification Search

CPC ..... A42B 3/324; A42B 3/322; A42B 3/328; A42B 3/32; A42B 3/064; A42B 3/06; A42B 3/145

(Continued)

(56) References Cited

U.S. PATENT DOCUMENTS 4,539,715 A 9/1985 Clement
5,956,776 A 9/1999 Chartrand (Continued)

FOREIGN PATENT DOCUMENTS

CA 2942637 3/2017

OTHER PUBLICATIONS

Office Action dated Apr. 12, 2019 in connection with U.S. Appl. No. 15/270,623, 29 pages.

(Continued)

*Primary Examiner* — Jameson D Collier

(57) ABSTRACT

A helmet for protecting a wearer's head. The helmet includes an outer shell including a first shell member and a second shell member movable relative to one another in a longitudinal direction of the helmet to adjust a fit of the helmet on the wearer's head. The helmet includes an adjustment mechanism configured to control movement of the first shell member and the second shell member relative to one another. The adjustment mechanism includes an actuator movable between a first position in which the first shell member and the second shell member are allowed to move relative to one another and a second position in which the first shell member and the second shell member are precluded from moving relative to one another. The actuator is configured to lock the first shell member and the second shell member relative to one another without extending through a given one of the first shell member and the second shell member.

21 Claims, 14 Drawing Sheets

Related U.S. Application Data

(60) Provisional application No. 62/221,072, filed on Sep. 20, 2015.

(51) Int. Cl.
*A63B 102/14* (2015.01)
*A63B 102/18* (2015.01)
*A63B 102/24* (2015.01)

(52) U.S. Cl.
CPC ..... *A63B 2102/18* (2015.10); *A63B 2102/24* (2015.10); *A63B 2243/007* (2013.01); *A63B 2244/19* (2013.01); *A63B 2244/24* (2013.01)

(58) Field of Classification Search
USPC ..... 2/417, 418, 420, 425
See application file for complete search history.

(56) References Cited

U.S. PATENT DOCUMENTS

| | | | |
|---|---|---|---|
| 6,324,700 | B1 | 12/2001 | McDougall |
| 6,966,075 | B2 | 11/2005 | Racine |
| 6,981,284 | B2 | 1/2006 | Durocher |
| 7,634,820 | B2 | 12/2009 | Rogers |
| 7,677,538 | B2 | 3/2010 | Darnell |
| 7,870,618 | B2 | 1/2011 | Pilon |
| 8,095,995 | B2 | 1/2012 | Alexander |
| 10,722,777 | B2 | 7/2020 | Durocher et al. |
| 2004/0172739 | A1 | 9/2004 | Racine |
| 2007/0169251 | A1 | 7/2007 | Rogers |
| 2009/0044315 | A1 | 2/2009 | Belanger |
| 2010/0258988 | A1 | 10/2010 | Darnell |
| 2012/0011639 | A1 | 1/2012 | Beauchamp |
| 2013/0025031 | A1 | 1/2013 | Laperriere |
| 2013/0025032 | A1 | 1/2013 | Durocher |
| 2013/0025033 | A1 | 1/2013 | Durocher |
| 2013/0318691 | A1 | 12/2013 | Krick |
| 2017/0079363 | A1 | 3/2017 | Durocher et al. |

OTHER PUBLICATIONS

Restriction Requirement dated Oct. 10, 2018 in connection with U.S. Appl. No. 15/270,623, 6 pages.
Final Office Action dated Jan. 14, 2020 in connection with U.S. Appl. No. 15/270,623, 23 pages.
Notice of Allowance dated Mar. 20, 2020 in connection with U.S. Appl. No. 15/270,623, 9 pages.

HELMET

CROSS-REFERENCE TO RELATED APPLICATION

This application claims priority from U.S. Provisional Patent Application 62/221,072 filed on Sep. 20, 2015 and which is incorporated by reference herein.

FIELD

The invention relates generally to helmets and, more particularly, to adjustable helmets providing impact protection (e.g., during sports or other activities).

BACKGROUND

Helmets are worn in sports (e.g., hockey, lacrosse, football, etc.) and other activities (e.g., motorcycling, industrial work, military activities, etc.) to protect their wearers against head injuries. Certain helmets can be adjustable so that a fit of the helmet on a wearer's head can be adjusted.

In particular, some helmets comprise a front shell member and a rear shell member and an adjustment system that allows relative movement between the front and rear shell members of the helmet in order to adjust the fit of the helmet on the wearer's head. While such adjustment systems provide a desired adjustment of the helmet, they may also present certain disadvantages. For instance, the adjustment system may sometimes be bulky or otherwise affect an appearance (e.g., dimensions) of the helmet and/or may be prone to damage (e.g., deformation, breaking) which may prevent or otherwise affect proper functioning of the adjustment system.

For these and/or other reasons, there is a need to improve adjustable helmets.

SUMMARY

In accordance with one aspect of the invention, there is provided a helmet for protecting a wearer's head. The helmet comprises an outer shell comprising a first shell member and a second shell member movable relative to one another in a longitudinal direction of the helmet to adjust a fit of the helmet on the wearer's head. The helmet comprises an adjustment mechanism configured to control movement of the first shell member and the second shell member relative to one another. The adjustment mechanism comprises an actuator movable between a first position in which the first shell member and the second shell member are allowed to move relative to one another and a second position in which the first shell member and the second shell member are precluded from moving relative to one another. The actuator is configured to lock the first shell member and the second shell member relative to one another without extending through a given one of the first shell member and the second shell member.

In accordance with another aspect of the invention, there is provided a helmet for protecting a wearer's head. The helmet comprises an outer shell comprising a first shell member and a second shell member movable relative to one another to adjust a size of a cavity for receiving the wearer's head. The helmet also comprises an adjustment mechanism comprising an actuator movable between a first position in which the size of the cavity can be adjusted and a second position in which the size of the cavity is prevented from being adjusted. The actuator comprises a projection and the first shell member comprises a plurality of recesses formed on a surface of the first shell member. When the actuator is in the second position and the cavity is of a first size, the projection is received in a first one of the recesses. When the actuator is in the second position and the cavity is of a second size, the projection is received in a second one of the recesses.

In accordance with another aspect of the invention, there is provided a helmet for protecting a wearer's head. The helmet comprises an outer shell comprising a first shell member and a second shell member movable relative to one another in a longitudinal direction of the helmet to adjust a fit of the helmet on the wearer's head. The helmet further comprises an adjustment mechanism configured to control movement of the first shell member and the second shell member relative to one another. The adjustment mechanism comprises an actuator movable between a first position in which the first shell member and the second shell member are allowed to move relative to one another and a second position in which the first shell member and the second shell member are precluded from moving relative to one another. The actuator is configured to lock the first shell member and the second shell member relative to one another by extending through the first shell member and without extending through the second shell member.

In accordance with another aspect of the invention, there is provided a helmet for protecting a wearer's head. The helmet comprises an outer shell comprising a first shell member and a second shell member movable relative to one another in a longitudinal direction of the helmet to adjust a fit of the helmet on the wearer's head. The helmet further comprises adjustment mechanism configured to control movement of the first shell member and the second shell member relative to one another. The adjustment mechanism comprises an actuator movable between a first position in which the first shell member and the second shell member are allowed to move relative to one another and a second position in which the first shell member and the second shell member are precluded from moving relative to one another. The actuator comprises a locking projection configured to lock the first shell member and the second shell member relative to one another, the actuator engages a point of attachment of the first shell member and the second shell member.

In accordance with another aspect of the invention, there is provided a helmet for protecting a wearers head. The helmet comprises a first shell member and a second shell member movable relative to one another in a longitudinal direction of the helmet to adjust a fit of the helmet on the wearer's head. The helmet further comprises an adjustment mechanism. The adjustment mechanism comprises a first component that sandwiches the second shell member to the first shell member and having at least one protrusion protruding from the first shell member. The adjustment mechanism also comprises a second component connected to the first component at the at least one protrusion to inhibit desandwiching of the second shell member from the first shell member. The second component has at least one projection adjacent at least one of the at least one protrusion and pivotally movable to a position where the at least one projection engages the second shell member to lock the first and second shell members against movement in the longitudinal direction.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1:
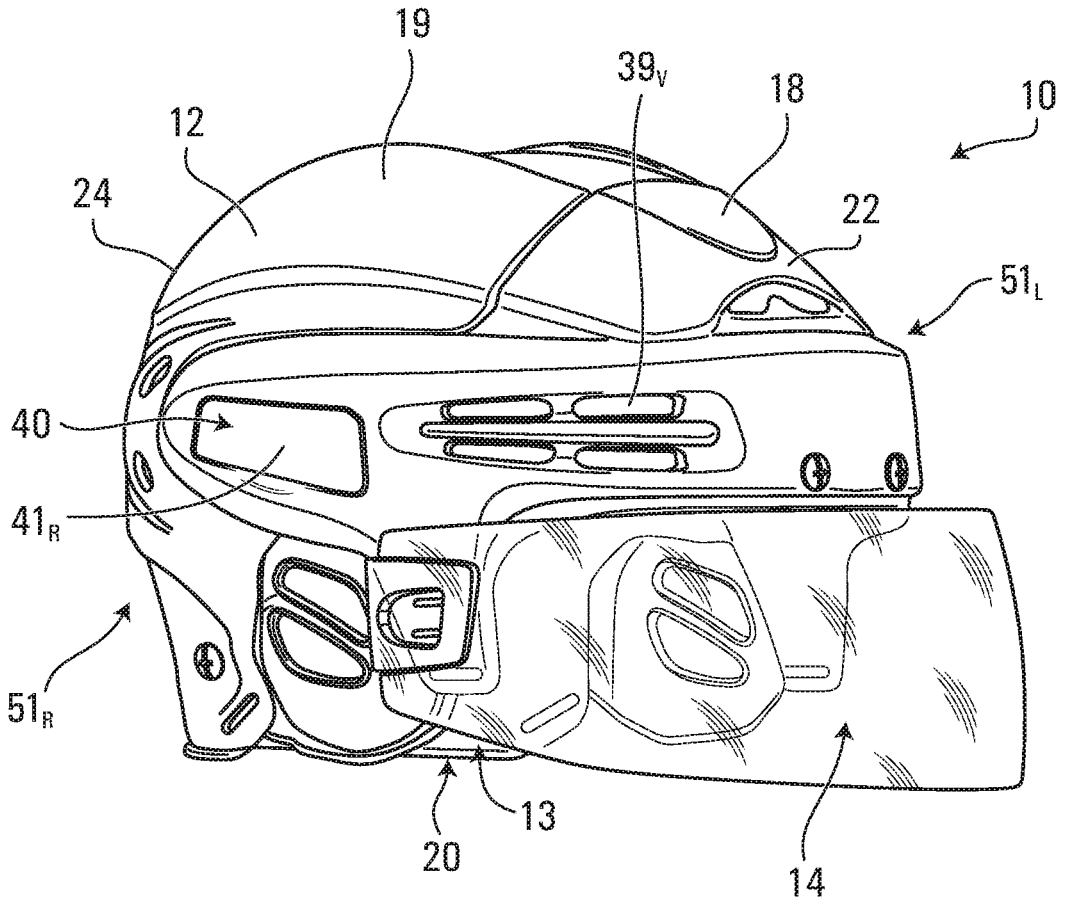
FIG. 1 is a perspective view of an example of a helmet in accordance with a non-limiting embodiment.
Figure 2:
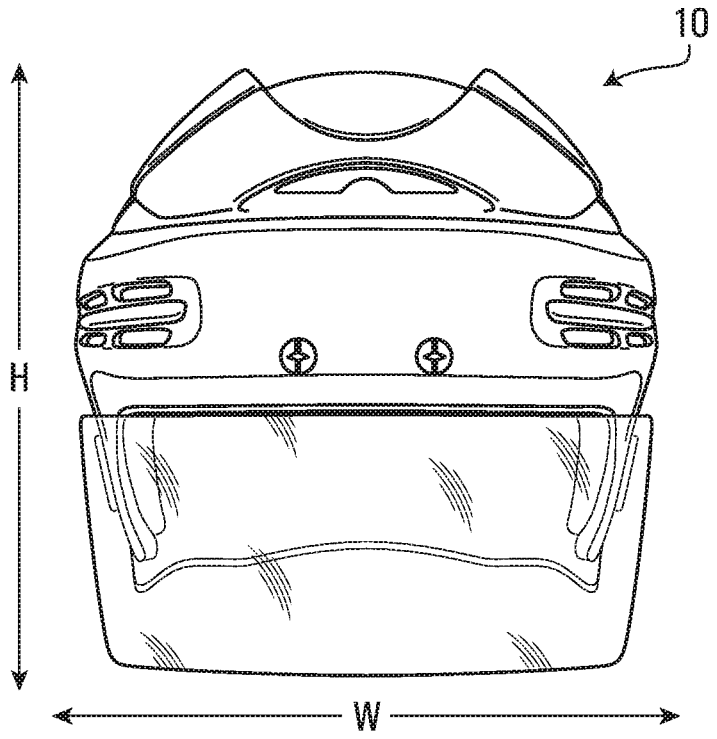
FIGS. 2 and 3 are a front and a side elevation view of the helmet.
Figure 3:
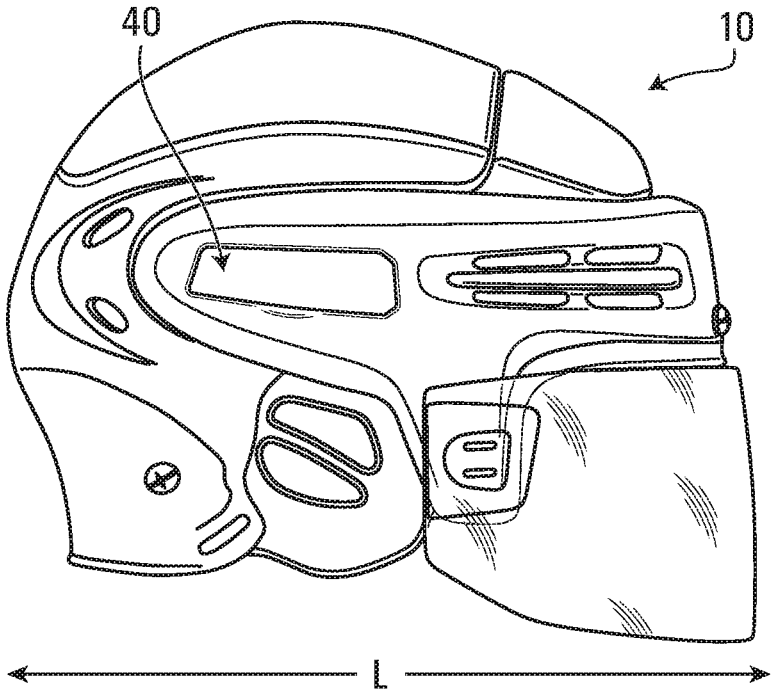

FIGS. 1 to 3 show an example of a helmet 10 for protecting a head 11 of a wearer in accordance with an embodiment of the invention. In this embodiment, the helmet 10 is a sports helmet and the wearer is a sports player. More particularly, in this embodiment, the helmet 10 is a hockey helmet for protecting the head 11 of the wearer who is a hockey player. In other embodiments, the helmet 10 may be any other type of helmet for other sports (e.g., lacrosse, football, baseball, cycling, skiing, snowboarding, horseback riding, etc.) and activities other than sports (e.g., motorcycling, industrial applications, military applications, etc.) in which protection against head injury is desired.

The helmet 10 defines a cavity 13 for receiving the wearer's head 11 to protect the wearer's head 11 when the helmet 10 is impacted (e.g., when the helmet 10 hits a board or an ice or other skating surface of a hockey rink or is struck by a puck or a hockey stick). In this embodiment, the helmet 10 may provide protection against various types of impacts, including high-energy impacts and low-energy impacts.

As further discussed below, in this embodiment, the helmet 10 is adjustable to adjust how it fits on the wearer's head 11 and its adjustability is implemented by taking up less space, which may enable it to provide better protection (e.g., include more padding in certain areas) and/or have a more pleasing appearance (e.g., be less bulky in certain areas).

Figure 4:
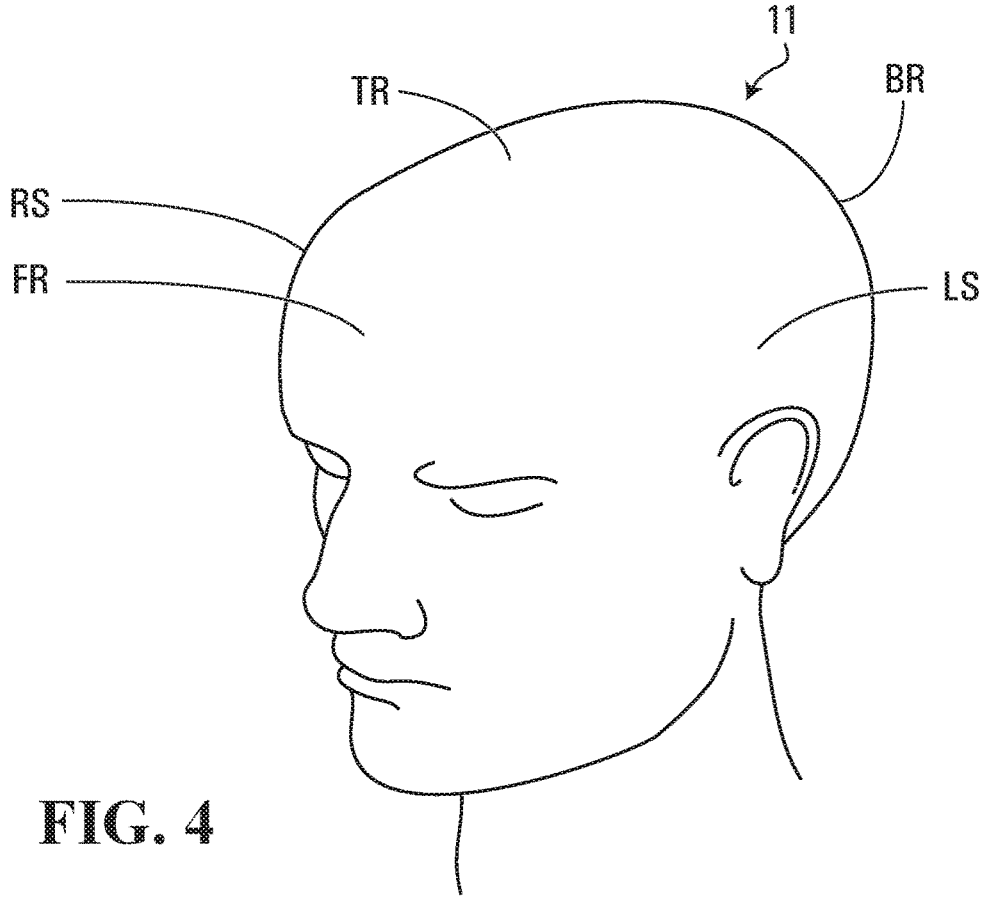
FIGS. 4 and 5 show a head of a wearer of the helmet.
Figure 5:
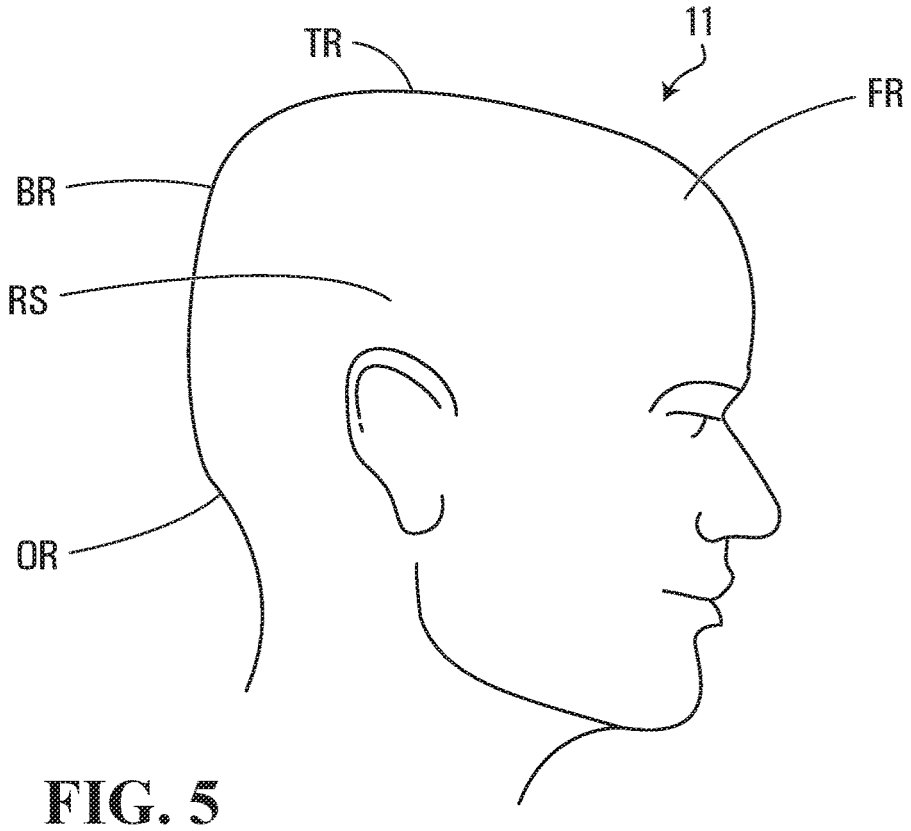

In response to an impact, the helmet 10 absorbs energy from the impact to protect the wearer's head 11. The helmet 10 protects various regions of the wearer's head 11. As shown in FIGS. 4 and 5, the wearer's head 11 comprises a front region FR, a top region TR, left and right side regions LS, RS, a back region BR, and an occipital region OR. The front region FR includes a forehead and a front top part of the head 11 and generally corresponds to a frontal bone region of the head 11. The left and right side regions LS, RS are approximately located above the wearer's ears. The back region BR is opposite the front region FR and includes a rear upper part of the head 11. The occipital region OR substantially corresponds to a region around and under the head's occipital protuberance.

The helmet 10 comprises an external surface 18 and an internal surface 20 that contacts the wearer's head 11 when the helmet 10 is worn. The helmet 10 has a front-back axis FBA, a left-right axis LRA, and a vertical axis VA which are respectively generally parallel to a dorsoventral axis, a dextrosinistral axis, and a cephalocaudal axis of the wearer when the helmet 10 is worn and which respectively define a front-back direction, a lateral direction, and a vertical direction of the helmet 10. Since they are generally oriented longitudinally and transversally of the helmet 10, the front-back axis FBA and the left-right axis LRA can also be referred to as a longitudinal axis and a transversal axis, respectively, while the front-back direction and the lateral direction can also be referred to a longitudinal direction and a transversal direction, respectfully. As shown in FIGS. 2 and 3, a length L of the helmet 10 is a dimension of the helmet 10 in its longitudinal direction, a width W of the helmet 10 is a dimension of the helmet 10 in its transversal direction, and a height H of the helmet 10 is a dimension of the helmet 10 in its vertical direction.

In this embodiment, the helmet 10 comprises an outer shell 12 and inner padding 15. The inner padding 15 is disposed between the outer shell 12 and the wearer's head 11 in use to absorb impact energy when the helmet 10 is impacted. The helmet 10 may also comprise a chinstrap (not shown) for securing the helmet 10 to the wearer's head 11. A faceguard 14 may also be provided to protect at least part of the wearer's face (e.g., a grid (sometimes referred to as a "cage") or a visor (sometimes referred to as a "shield")).

The outer shell 12 provides strength and rigidity to the hockey helmet 10. To that end, the outer shell 12 is made of rigid material. For example, in various embodiments, the outer shell 12 may be made of thermoplastic material such as polyethylene (PE), polyimide (nylon), or polycarbonate, of thermosetting resin, or of any other suitable material. The outer shell 12 has an inner surface 17 facing the inner padding 15 and an outer surface 19 opposite the inner surface 17. The outer surface 19 of the outer shell 12 constitutes at least part of the external surface 18 of the helmet 10.

Figure 7:
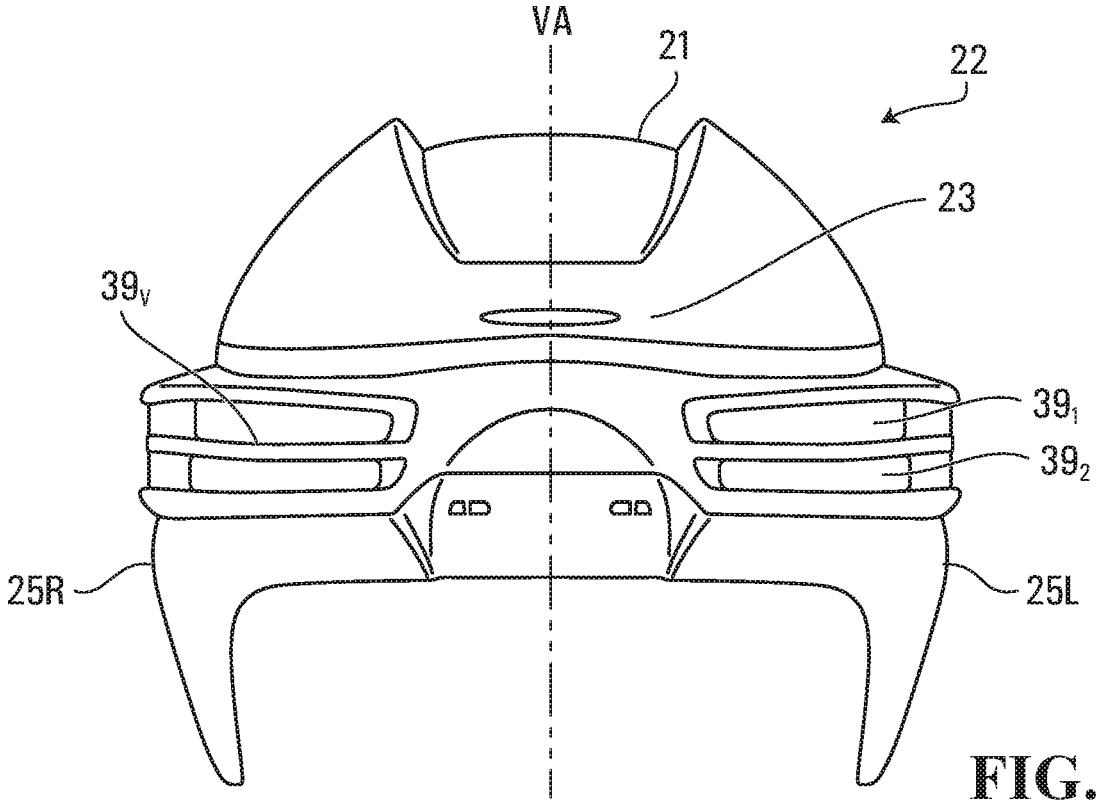
FIGS. 7 and 8 are a front and a side elevation view of a front shell member of the helmet.
Figure 8:
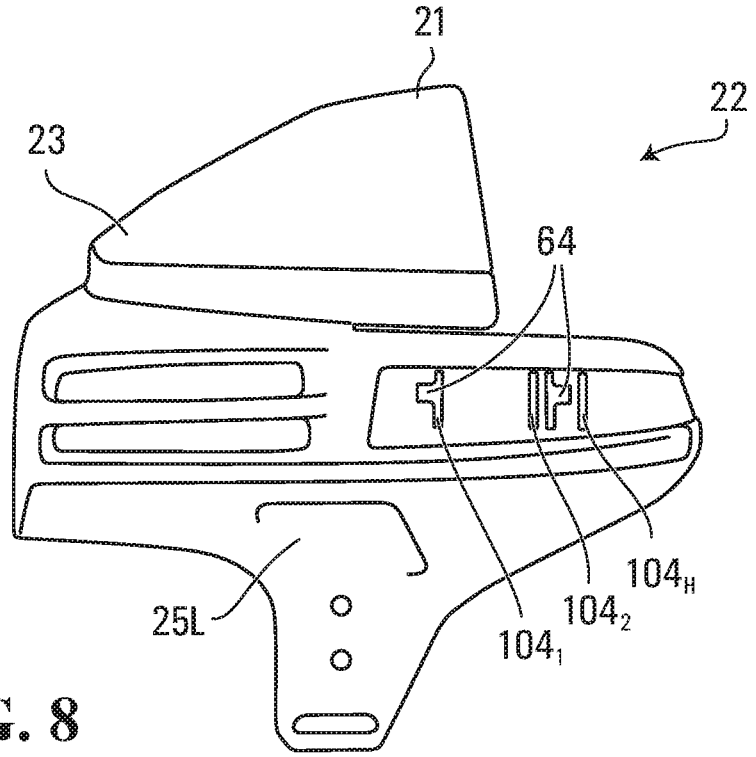
Figure 9:
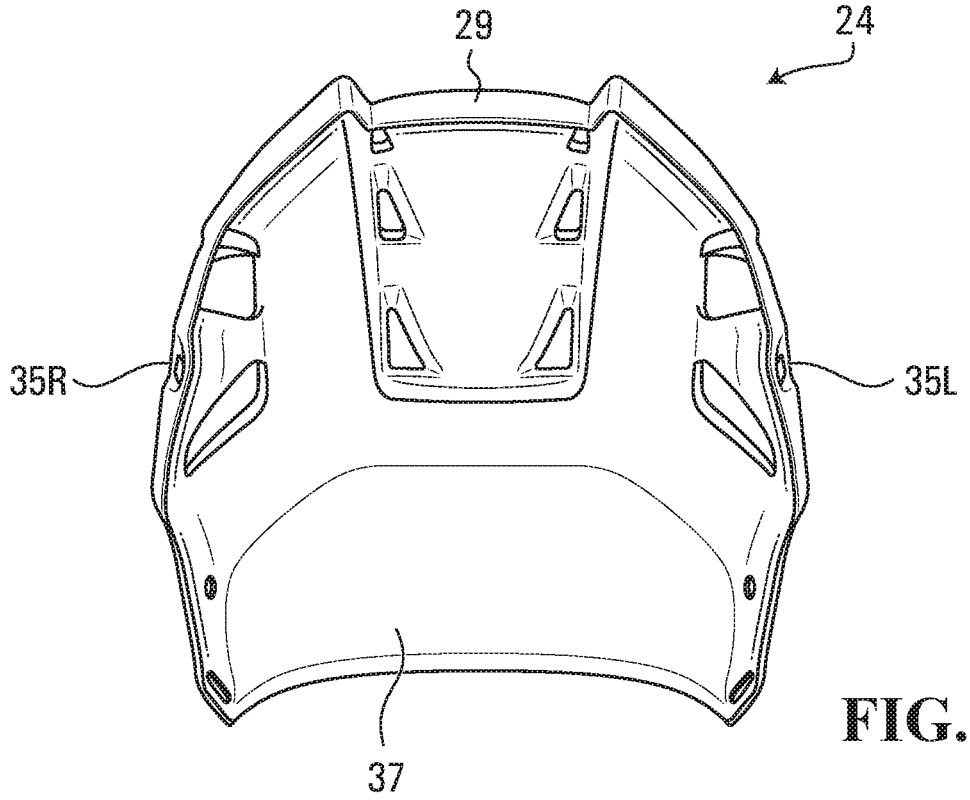
FIGS. 9 and 10 are a front and a side elevation view of a rear shell member of the helmet.

In this embodiment, the outer shell 12 comprises a front shell member 22 and a rear shell member 24 that are connected to one another. As shown in FIGS. 7 and 8, the front shell member 22 comprises a top portion 21 for facing at least part of the top region TR of the wearer's head 11, a front portion 23 for facing at least part of the front region FR of the wearer's head 11, and left and right side portions 25L, 25R extending rearwardly from the front portion 23 for facing at least part of the left and right side regions LS, RS of the wearer's head 11, respectively. The rear shell member 24 comprises a top portion 29 for facing at least part of the top region TR of the wearer's head 11, a back portion 31 for facing at least part of the back region BR of the wearer's head 11, an occipital portion 37 for facing at least part of the occipital region OR of the wearer's head 11, and left and right side portion 35L, 35R extending forwardly from the back portion 31 for facing at least part of the left and right side regions LS, RS of the wearer's head 11, respectively.

Figure 6:
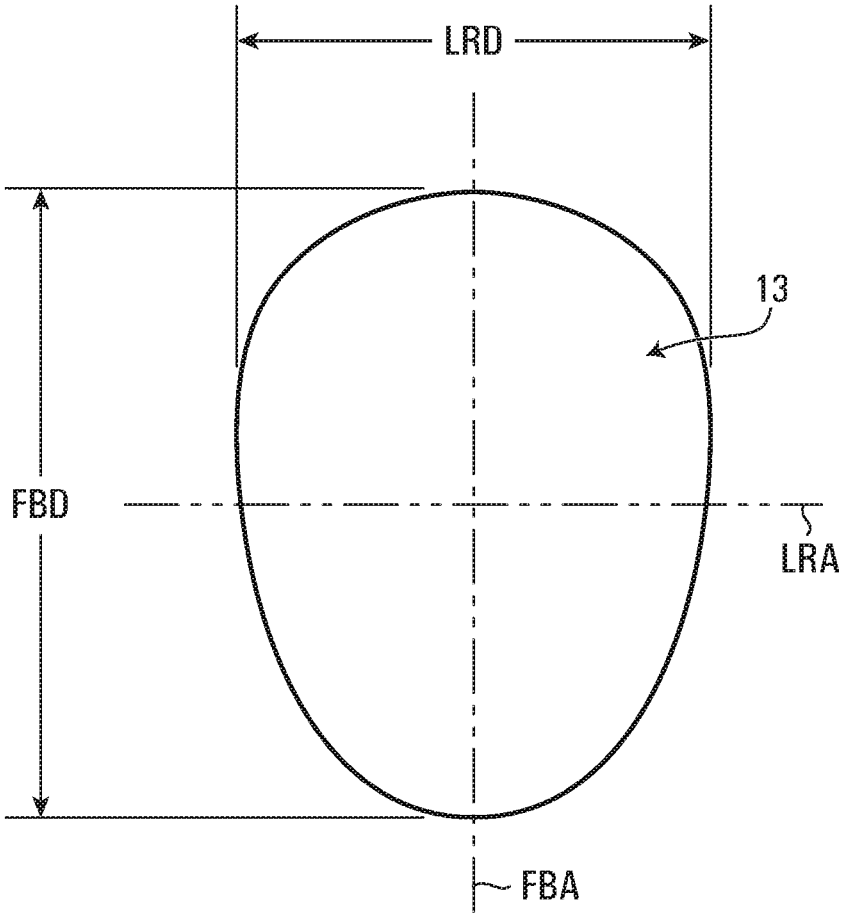
FIG. 6 shows internal dimensions of a head-receiving cavity of the helmet.

In this embodiment, the helmet 10 is adjustable to adjust how it fits on the wearer's head 11. To that end, the helmet 10 comprises an adjustment mechanism 40 for adjusting a fit of the helmet 10 on the wearer's head 11. The adjustment mechanism 40 may allow the fit of the helmet 10 to be adjusted by adjusting one or more internal dimensions of the cavity 13 of the helmet 10, such as a front-back internal dimension FBD of the cavity 13 in the front-back direction of the helmet 10 and/or a left-right internal dimension LRD of the cavity 13 in the left-right direction of the helmet 10, as shown in FIG. 6.

More particularly, in this embodiment, the adjustment mechanism 40 allows the front shell member 22 and the rear shell member 24 to move relative to one another to adjust the fit of the helmet 10 on the wearer's head 11. The front shell member 22 and the rear shell member 24 may comprise smooth, interference-free sliding surfaces that are adapted to face or be in contact with each other when the fit of the helmet 10 is adjusted to a selected size. In this example, relative movement of the shell members 22, 24 for adjustment purposes is in the front-back direction of the helmet 10 such that the front-back internal dimension FBD of the cavity 13 of the helmet 10 is adjusted. This dimension may be adjusted between a minimum size of the helmet 10, a maximum size of the helmet 10 and zero or more intermediate sizes of the helmet 10.

In this embodiment, the adjustment mechanism 40 comprises a left adjustment element $\mathbf{41}_L$ disposed on a left side $\mathbf{51}_L$ of the helmet 10 and a right adjustment element $\mathbf{41}_R$ disposed on a right side $\mathbf{51}_R$ of the helmet 10. In this example, the left and right adjustment elements $\mathbf{41}_L$, $\mathbf{41}_R$ are each disposed in a position in the vertical direction of the helmet 10 slightly above the wearer's ear. It should be understood that, in this embodiment, the left side $\mathbf{51}_L$ of the helmet 10 is homologous to the right side $\mathbf{51}_R$ of the helmet 10 and, therefore, the below description of components with respect to one side of the helmet 10 also applies to the other side of the helmet 10. However, this need not be the case in all embodiments. For example, the adjustment mechanism 40 may comprise more than two adjustment elements like the adjustment elements $\mathbf{41}_L$, $\mathbf{41}_R$ or there may only be a single adjustment element like the adjustment elements $\mathbf{41}_L$, $\mathbf{41}_R$ in the helmet 10.

Each of the adjustment elements $\mathbf{41}_L$, $\mathbf{41}_R$ of the adjustment mechanism 40 comprises an actuator 60 movable between (i) a first position, referred to an "open position", in which the front shell member 22 and the rear shell member 24 are allowed to move relative to one another to adjust the fit of the helmet 10 and (ii) a second position, referred to as a "closed position", in which the front shell member 22 and the rear shell member 24 are precluded from moving relative to one another so as to maintain the fit of the helmet 10 as adjusted.

In this embodiment, the actuator 60, which will be described in further detail later on, comprises a plurality of locking projections $\mathbf{84}_1$-$\mathbf{84}_P$ configured to lock the front shell member 22 and the rear shell member 24 relative to one another in the closed position of the actuator 60. The actuator 60 is relatively small such that it occupies less space in the helmet 10. Notably, in this embodiment, the locking projections $\mathbf{84}_1$-$\mathbf{84}_P$ are dimensioned such that they can lock the front shell member 22 and the rear shell member 24 relative to one another in the closed position without extending through a given one of the front shell member 22 and the rear shell member 24. In this case, the locking projections $\mathbf{84}_1$-$\mathbf{84}_P$ can lock the front shell member 22 and the rear shell member 24 relative to one another in the closed position while penetrating into the rear shell member 24 yet without extending through it.

In addition to the actuator 60, each of the adjustment elements $\mathbf{41}_L$, $\mathbf{41}_R$ of the adjustment mechanism 40 also comprises a plurality of openings $\mathbf{104}_1$-$\mathbf{104}_H$ on the front shell member 22 and a plurality of recesses (also referred to as "locking recesses") $\mathbf{100}_1$-$\mathbf{100}_R$ on the rear shell member 24. These are respectively aligned with the locking projections $\mathbf{84}_1$-$\mathbf{84}_P$ of the actuator 60 such that the locking projections $\mathbf{84}_1$-$\mathbf{84}_P$ of the actuator 60 may extend through respective ones of the openings $\mathbf{104}_1$-$\mathbf{104}_H$ of the front shell member 22 and be received in corresponding ones of the recesses $\mathbf{100}_1$-$\mathbf{100}_R$ of the rear shell member 24 to lock the front shell member 22 and the rear shell member 24 relative to one another. As they are received in the corresponding ones of the recesses $\mathbf{100}_1$-$\mathbf{100}_R$ of the rear shell member 24, the locking projections $\mathbf{84}_1$-$\mathbf{84}_P$ of the actuator 60 do not extend through the rear shell member 24. Conversely, the locking projections $\mathbf{84}_1$-$\mathbf{84}_P$ of the actuator 60 may be moved out of the recesses $\mathbf{100}_1$-$\mathbf{100}_R$ of the rear shell member 24 to allow relative movement of the front shell member 22 and the rear shell member 24 while the actuator 60 remains in the open position.

Each of the adjustment elements $\mathbf{41}_L$, $\mathbf{41}_R$ of the adjustment mechanism 40 is substantially aligned with a recessed region 61 of the front shell member 22 on a respective one of the left and right side portions 25L, 25R of the front shell member 22. For instance, the actuator 60 of each of the adjustment elements $\mathbf{41}_L$, $\mathbf{41}_R$ is received in the recessed region 61 of the front shell member 22.

Figure 11:
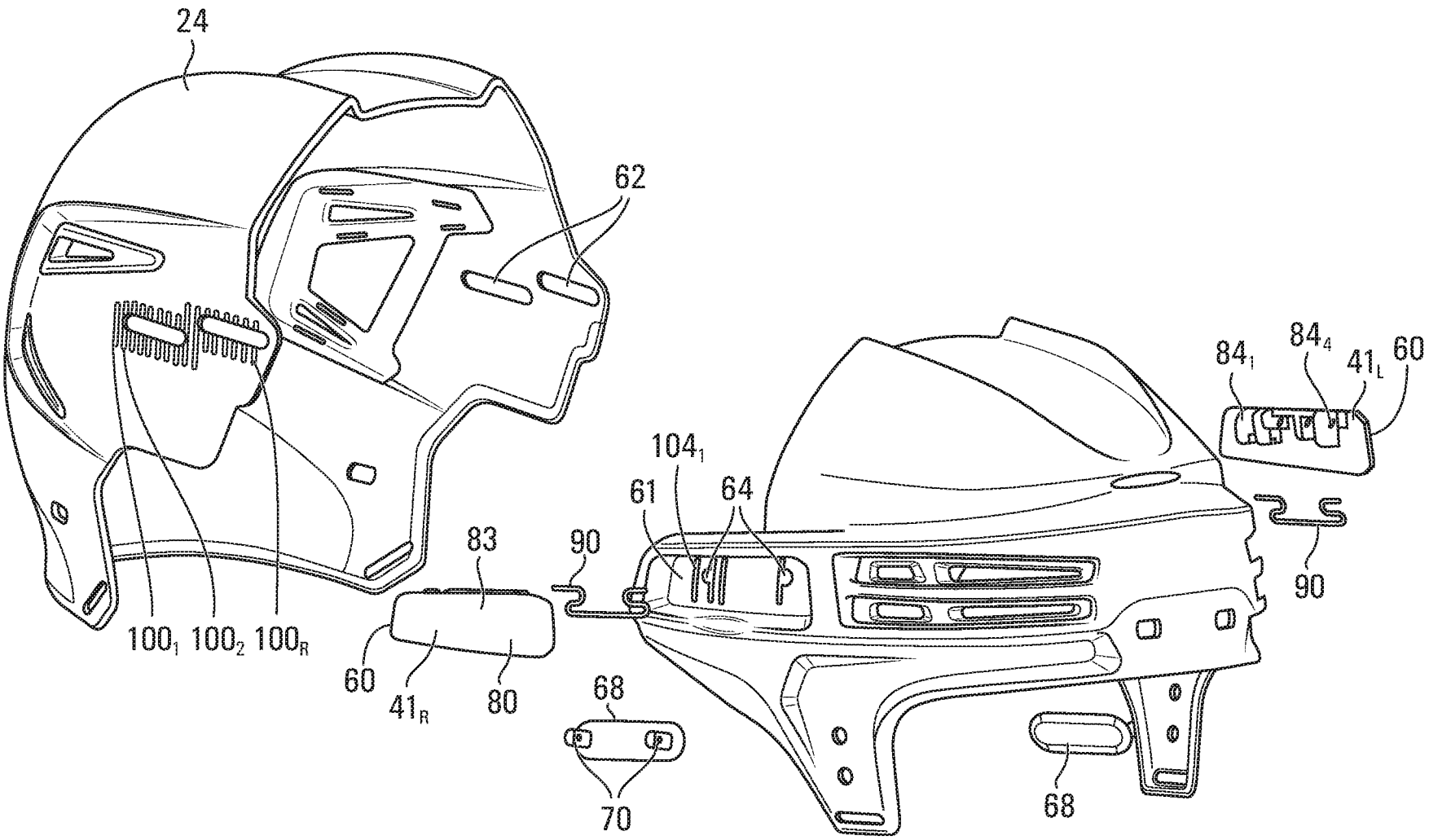
FIG. 11 is an exploded view of an outer shell of the helmet and an adjustment mechanism of the helmet.
Figure 21:
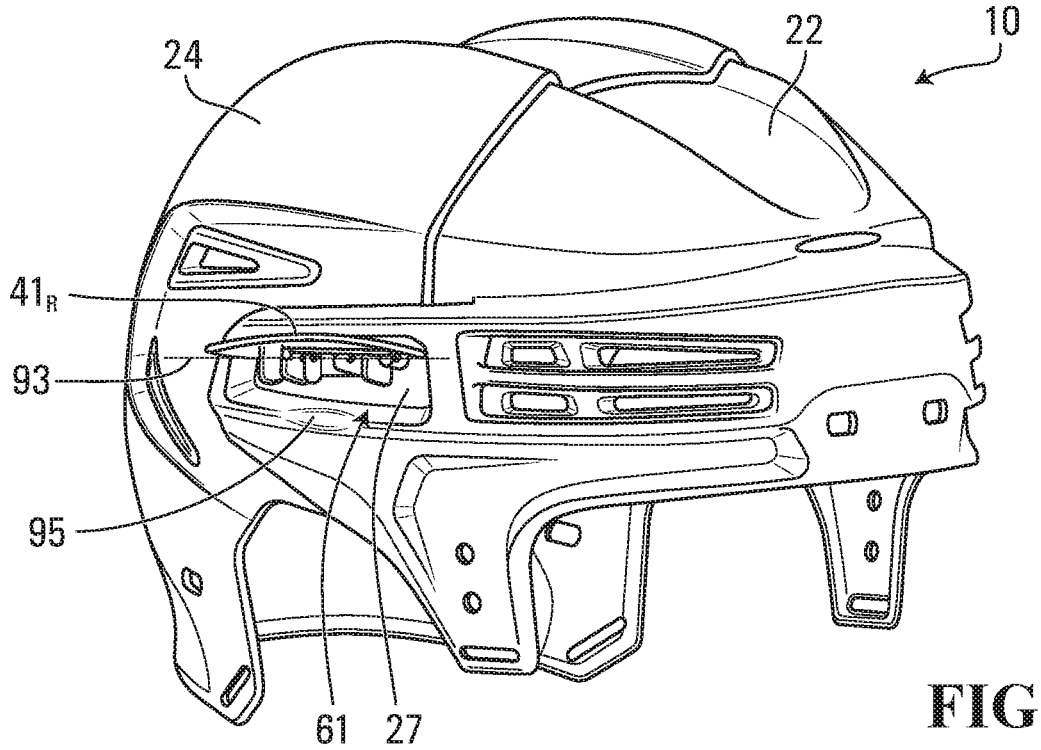
Figure 22:
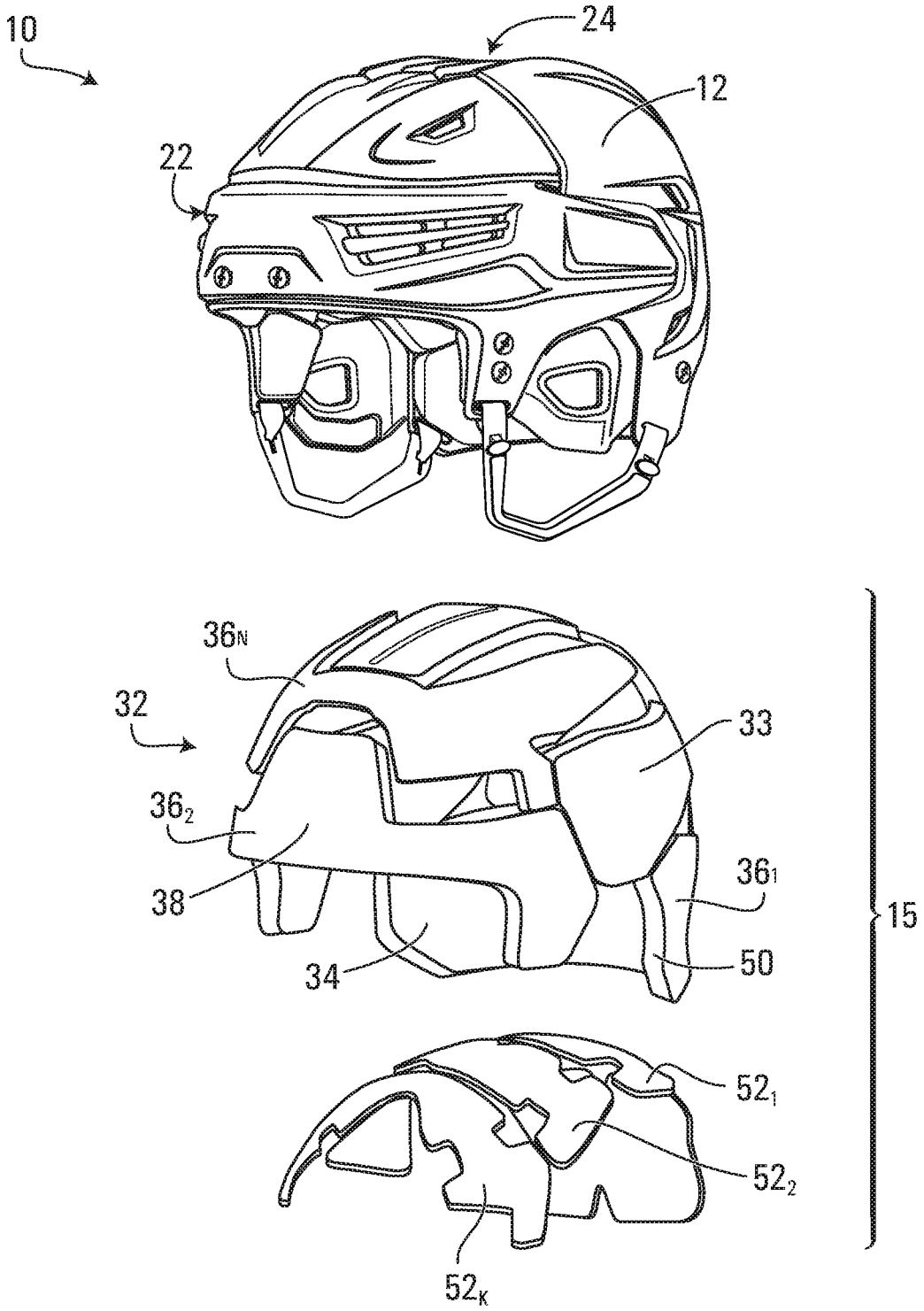
FIG. 22 shows an exploded view of the helmet, including an inner padding of the helmet.

In this embodiment, as shown in FIGS. 11 and 21, each of the adjustment elements $\mathbf{41}_L$, $\mathbf{41}_R$ of the adjustment mechanism 40 comprises a "point of attachment" of the front shell member 22 and the rear shell member 24. The point of attachment of the front and rear shell members 22, 24 is a point at which the front and rear shell members 22, 24 are interconnected. In particular, in this embodiment, the point of attachment of the first and second shell members 22, 24 is implemented by a peg plate 68 of each of the adjustment elements $\mathbf{41}_L$, $\mathbf{41}_R$. The actuator 60 comprises a pivot member 90 that engages the peg plate 68 to the actuator 60 such that the peg plate 68 supports the actuator 60. Thus, the peg plate 68, together with the pivot member 90, interconnects the front shell member 22 and the rear shell member 24 while the actuator 60 is in the open position and the helmet 10 is being adjusted. In other words, the peg plate 68 and the pivot member 90 preclude the front and rear shell members 22, 24 from entirely disengaging one another.

Since, in this embodiment, it is mounted to the pivot member 90 and thus pivotable relative to the front shell member 22 and the rear shell member 24, the actuator 60 constitutes a lever.

Figure 12:
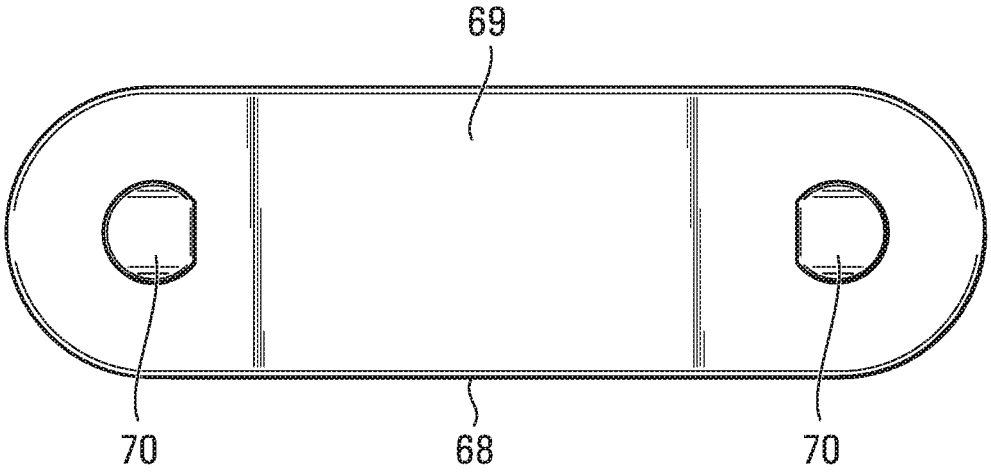
FIGS. 12 and 13 are a front and a side elevation view of a peg plate of an adjustment element of the adjustment mechanism.
Figure 13:
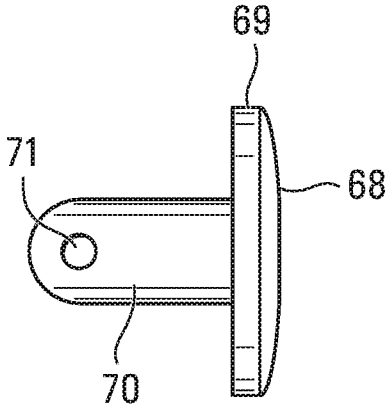
Figure 14:
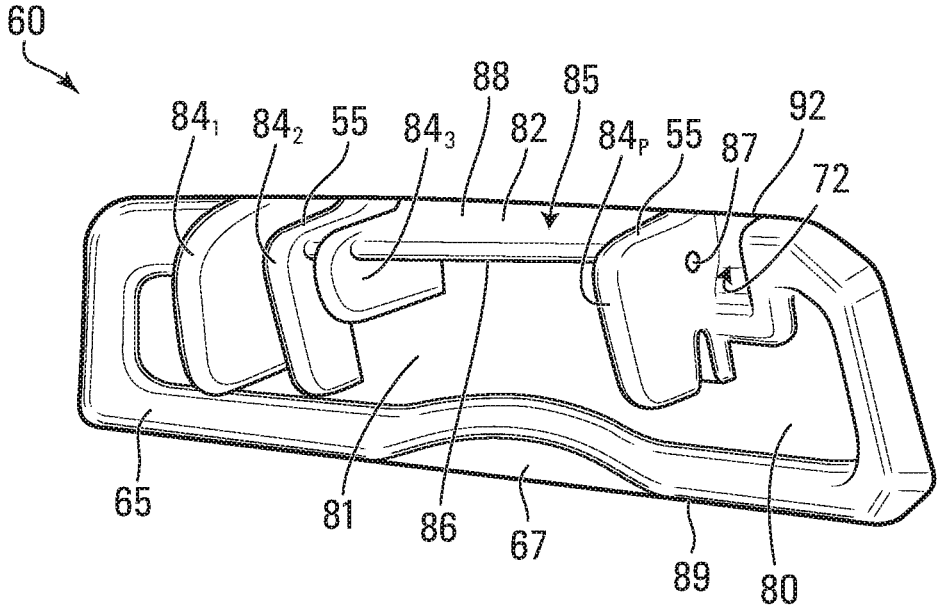
FIG. 14 is a perspective view of an actuator of the adjustment element for selectively allowing and precluding relative movement between the front and rear shell members of the helmet.

As shown in FIGS. 12 and 13, in this embodiment, the peg plate 68 comprises a base portion 69 and a pair of pegs 70 protruding from the base portion 69, the pegs 70 being configured to be received in the front and rear shell members 22, 24, In use, the peg plate 68 is positioned such that its base portion 69 is disposed between the rear shell member 24 and the inner padding 15 with the pegs 70 extending outwardly (i.e., away from the wearer's head), in the lateral direction of the helmet 10, and traversing the front and rear shell members 22, 24 such that the pegs 70 protrude outwards from the front shell member 22. Thus, the peg plate 68 may be considered to "sandwich" the front and rear shell members 22, 24, while the actuator 60 inhibits "desandwiching" or separation of the front and rear shell members 22, 24.

Figure 19:
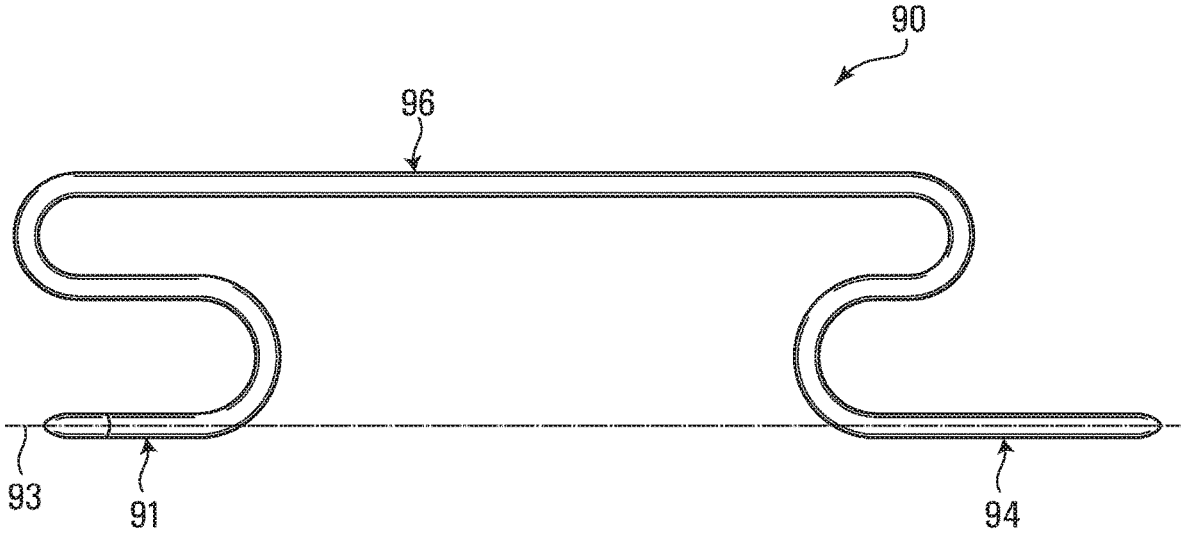
FIG. 19 is a front elevation view of a pivot member of the actuator.

In this embodiment, as shown in FIG. 19, the pivot member 90 is a spring wire. The pivot member 90 comprises a first end portion 91 and a second end portion 94 which are configured to be received in the pegs 70 of the peg plate 68. In use, the first and second end portions 91, 94 extend along a direction generally parallel to the longitudinal direction of the helmet 10 such as to define a pivot axis 93 that is generally parallel to the longitudinal direction of the helmet 10. The pivot member 90 also comprises a central portion 96 spaced away from the first and second end portions 91, 94. More specifically, the central portion 96 lies away from the pivot axis 93 defined by the first and second end portions 91, 94.

In this embodiment, the pivot member 90 comprises a metallic material (e.g., steel). The pivot member 90 may comprise any other suitable material in other embodiments.

In order to receive the pegs 70 of the peg plate 68, the rear shell member 24 comprises a pair of parallel channels 62 at a position slightly above the wearer's ear in the vertical direction of the helmet 10. The channels 62 are elongate and extend predominantly in the longitudinal direction of the helmet 10. For its part, in order to receive the pegs 70 of the peg plate 68, the front shell member 22 comprises a pair of openings 64 which are aligned with the channels 62 when the front shell member 22 and the rear shell member 24 are interconnected.

Each of the pegs 70, which protrude from the recessed region 61 of the front shell member 22, is configured to receive the pivot member 90 of the actuator 60. For instance, in this example, the pivot member 90 is received in an opening 71 of a respective one of the pegs 70. This holds the front shell member 22 and the rear shell member 24 together, and as such, each of the pegs 70 of the peg plate 68 is considered to be a point of attachment of the front and rear shell members 22, 24. Through its pivot member 90, the actuator 60 thus engages at least one point of attachment of the front and rear shell members 22, 24, and in this particular example, engages two points of attachments of the front and rear shell members 22, 24 (i.e., the two pegs 70). If the actuator 60 is in the open position, the pegs 70 can slide back and forth within the channels 62, which allows the front-back internal dimension FB© of the cavity 13 of the helmet 10 to be varied, i.e., the fit of the helmet 10 can be adjusted.

In this embodiment, the actuator 60 comprises an actuator plate 80. The actuator plate 80 comprises an inner face 81 and an outer face 83, either or both of which may be curved in order to follow a general curvature of the outer shell 12. The actuator plate 80 comprises a lower edge 89 and an upper edge 92 opposite the lower edge 89. The lower and upper edges 89, 92 correspond to the lower and upper edges of the actuator 60. In the closed position of the actuator 60, the lower edge 89 is positioned lower in the vertical direction of the helmet 10 than the upper edge 92.

The actuator plate 80 may be made of the same rigid material as the front shell member 22 and/or the rear shell member 24. Alternatively, the actuator 60 may be made of a different material.

The actuator 60 also comprises a cam portion 85 for selectively placing the actuator 60 in its open and closed positions. In this example, the cam portion 85 of the actuator 60 comprises a cam post 82 which comprises one or more clevis members 72 on the inner face 81 of the actuator plate 80. The clevis members 72 are configured to receive the pegs 70 which protrude from the recessed region 61 of the front shell member 22 via the openings 64.

The pivot member 90 interacts with the pegs 70 of the peg plate 68 to provide a hinge connection which allows the actuator 60 to pivot about the pivot axis 93 such that the actuator 60 rotates in relation to the front and rear shell members 22, 24 of the helmet 10. To that end, the locking projections $84_1$-$84_P$ may comprise openings 87 configured to receive the pivot member 90 therein. In particular, the openings 87 receive the first and second end portions 91, 94 of the pivot member 90. In such examples, the openings 98 of the certain ones of the locking projections $84_1$-$84_P$ are aligned with one another. Other devices and shapes could be used in lieu of the pivot member 90 to implement such a hinge connection.

The cam post 82 comprises at least two surfaces, one of which contacts an outer surface 27 of the front shell member 22 when the actuator 60 is in the open position and the other of which contacts the outer surface 27 of the front shell member 22 when the actuator 60 is in the closed position. Specifically, when the actuator 60 is in the closed position, a "closed position cam surface" 86 of the cam post 82 rests against the outer surface 27 of the front shell member 22, and when the actuator 60 is in the open position, an "open position cam surface" 88 of the cam post 82 is in contact with the outer surface 27 of the front shell member 22.

Figure 18:
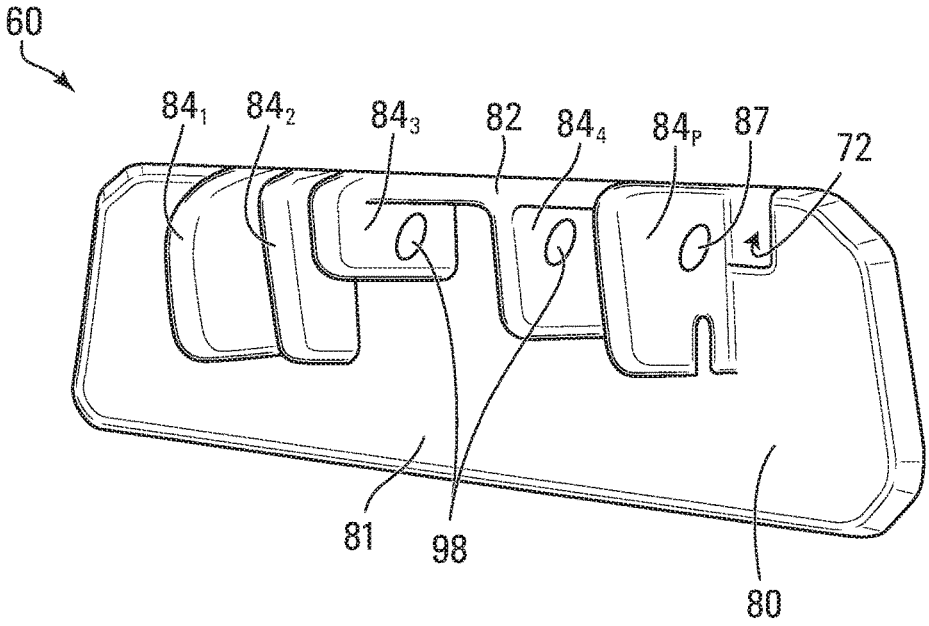
FIG. 18 is a perspective view of the actuator in accordance with another embodiment.

The actuator 60 also comprises the aforementioned locking projections $84_1$-$84_P$. The locking projections $84_1$-$84_P$ project away from the inner face 81 of the actuator plate 80 (which may be curved). For example, the locking projections $84_1$-$84_P$ may project perpendicularly to a plane tangent to at least one point on the curved outer face 83 of the actuator plate 80. In this embodiment, as shown in FIGS. 14 to 17, the actuator 60 comprises four locking projections $84_1$-$84_P$. However, in other embodiments, the actuator 60 may comprise more or less locking projections $84_1$-$84_P$. For example, as shown in FIG. 18, in some embodiments, the actuator 60 may comprise five or more locking projections $84_1$-$84_P$.

Furthermore, in this embodiment, at least one locking projection $84_i$ may be positioned such as to prevent or otherwise minimize bending of the locking projection $84_i$. More specifically, in this example of implementation, the locking projection $84_i$ is positioned such as to be adjacent to a given one of the pegs 70 of the peg plate 68 when the actuator 60 is in its closed position. Because each of the pegs 70 constitutes a point of attachment point between the front and rear shell members 22, 24, as discussed above, the outer shell 12 may be subjected to reduced bending at the pegs 70 compared to other points of the outer shell 12 along the longitudinal direction of the helmet 10. Thus, positioning a locking projection $84_i$ of the actuator 60 such as to be adjacent to one of the pegs 70 exposes the locking projection $84_i$ to reduced bending compared to other possible positions of the locking projection $84_i$. This may hence allow the use of shorter locking projections such that they may penetrate only part way into the rear shell member while still achieving satisfactory locking performance.

In this embodiment, the locking projections $84_1$-$84_P$ remain fixed in relation to the points of attachment of the front and rear shell members 22, 24 when the fit of the helmet 10 is adjusted to different sizes. More specifically, when the actuator 60 is in its closed position, a distance between a given locking projection $\mathbf{84}_i$ and a given one of the pegs 70 remains constant whether the helmet 10 is adjusted to a first size or a second size different from the first size.

The locking projections $\mathbf{84}_1$-$\mathbf{84}_P$ may be distributed at different points along the inner face 81 of the actuator plate 80. In this embodiment, the distribution occurs along an axis that is predominantly parallel to the pivot axis 93 and may be offset therefrom, although the general direction along which the locking projections $\mathbf{84}_1$-$\mathbf{84}_P$ are oriented may be different from the pivot axis 93. Moreover, in some embodiments, the locking projections $\mathbf{84}_1$-$\mathbf{84}_P$ may be evenly spaced from one another.

The locking projections $\mathbf{84}_1$-$\mathbf{84}_P$ need not be evenly distributed along the actuator plate 80, however a distance between adjacent locking projections $\mathbf{84}_1$-$\mathbf{84}_P$ is designed in relation to a distance between adjacent locking recesses $\mathbf{100}_1$-$\mathbf{100}_R$ on the rear shell member 24. For example, assuming that the distance between pairs of adjacent locking recesses $\mathbf{100}_1$-$\mathbf{100}_R$ on the rear shell member 24 is the same and is equal to "X" (which need not be the case in all embodiments), the distance between adjacent locking projections $\mathbf{84}_1$-$\mathbf{84}_P$ along the actuator plate 80 should be X, or a multiple thereof (i.e., an integer multiple), to allow proper alignment of the locking projections $\mathbf{84}_1$-$\mathbf{84}_P$ and a corresponding subset of the locking recesses $\mathbf{100}_1$-$\mathbf{100}_R$ in which those locking projections will be lodged. As such, there may be a greater number of locking recesses $\mathbf{100}_1$-$\mathbf{100}_R$ than of locking projections $\mathbf{84}_1$-$\mathbf{84}_P$. Having a greater number of locking recesses $\mathbf{100}_1$-$\mathbf{100}_R$ may allow the locking projections $\mathbf{84}_1$-$\mathbf{84}_P$ to be held within the locking recesses $\mathbf{100}_1$-$\mathbf{100}_R$ at a greater number of positions, each such position defining a different length of the front-back internal dimension FBD of the cavity 13 of the helmet 10. Thus, the fit of the helmet 10 may be adjusted with a more refined granularity.

For instance, in some cases, the distance between adjacent locking recesses $\mathbf{100}_1$-$\mathbf{100}_R$ may be at least 1 mm, in some cases at least 2 mm, in some cases at least 3 mm, in some cases at least 5 mm, in some cases at least 10 mm, in some cases at least 15 mm, in some cases at least 20 mm, in some cases at least 25 mm, and in some cases even more.

Figure 16:
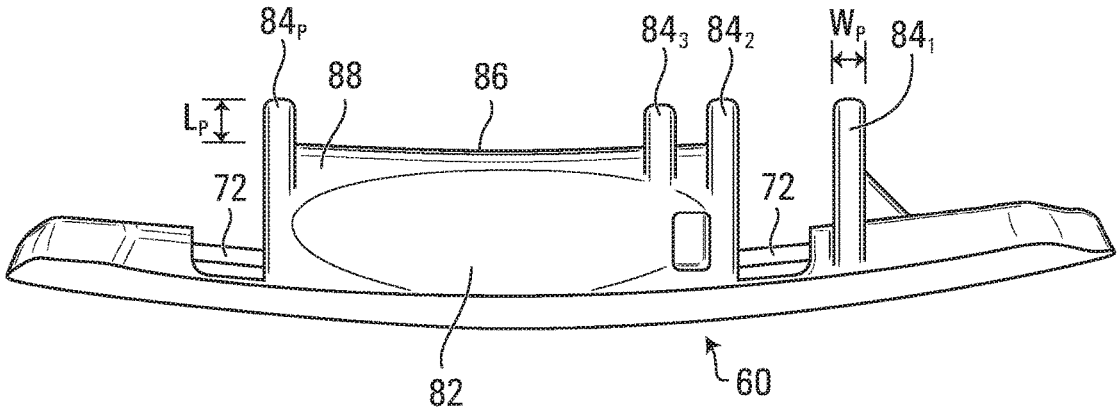
Figure 17:
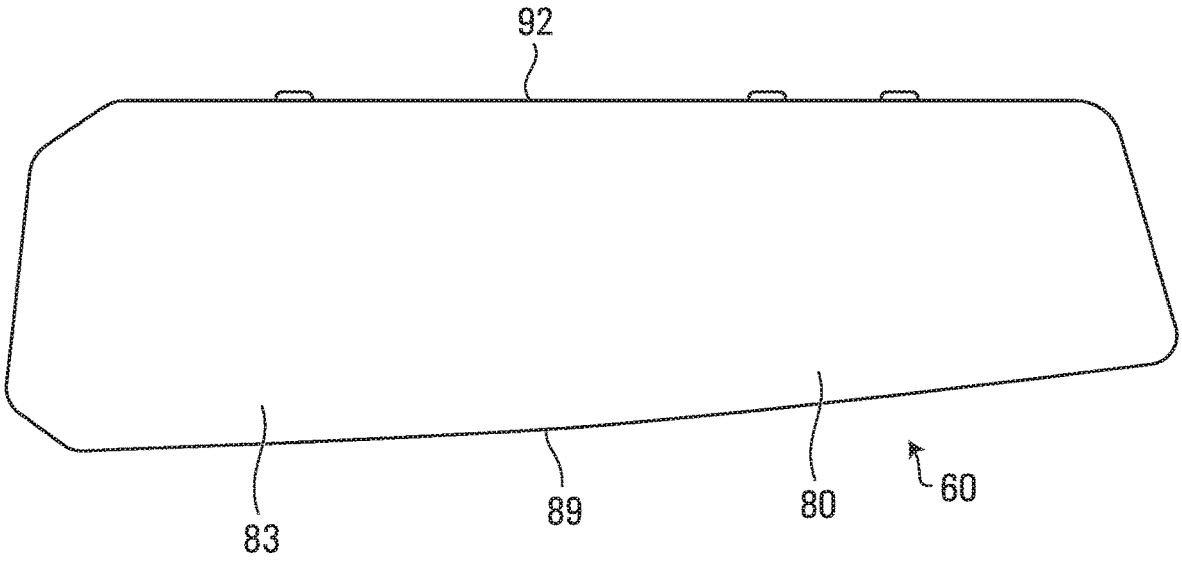

Each of the locking projections $\mathbf{84}_1$-$\mathbf{84}_P$ has a length $L_P$, a height $H_P$ and a width $W_P$. With reference to FIG. 16, the length $L_P$ of a given locking projection $\mathbf{84}_i$ is a distance by which that locking projection $\mathbf{84}_i$ protrudes into the front and rear shell members 22, 24 (i.e., the outer shell 12) of the helmet 10 when the actuator 60 is in the closed position. In other words, the length $L_P$ of the locking projection $\mathbf{84}_i$ is the distance by which the locking projection $\mathbf{84}_i$ extends past the closed position cam surface 86 when the actuator 60 is in the closed position. It is noted that the length $L_P$ of different ones of the locking projections $\mathbf{84}_1$-$\mathbf{84}_P$ may be slightly different because of the curvature of the front and rear shell members 22, 24 of the helmet 10.

In this embodiment, the length $L_P$ of a locking projection $\mathbf{84}_i$ may be relatively small. For instance, in some cases, the length $L_P$ of the locking projection $\mathbf{84}_i$ may be no more than 20 mm, in some cases, no more than 15 mm, in some cases no more than 10 mm, in some cases no more than 5 mm, in some cases no more than 3 mm and in some cases even less (e.g., 1.5 mm). This particularly small length of the locking projections $\mathbf{84}_1$-$\mathbf{84}_P$ may result in less deformation of the locking projections $\mathbf{84}_1$-$\mathbf{84}_P$ than if their length was greater. Consequently, this may result in a stronger adjustment mechanism 40 that is less prone to deformation.

Furthermore, in some cases, a ratio of the length $L_P$ of the locking projections $\mathbf{84}_1$-$\mathbf{84}_P$ over the width W of the helmet 10 may be no more than 1:15, in some cases no more than 1:20, in some cases no more than 1:30, in some cases no more than 1:50, in some cases no more than 1:70, in some cases no more than 1:100, in some cases no more than 1:150, in some cases no more than 1:170, and in some cases even less.

Furthermore, in some cases, assuming that the front shell member 22 has a maximum thickness A in the immediate vicinity of the openings $\mathbf{104}_1$-$\mathbf{104}_H$ and the rear shell member 24 has a maximum thickness B in the immediate vicinity of the locking recesses $\mathbf{100}_1$-$\mathbf{100}_R$, such that the front and rear shell members 22, 24 have a combined maximum thickness AB in the immediate vicinity of the openings $\mathbf{104}_1$-$\mathbf{104}_H$ and locking recesses $\mathbf{100}_1$-$\mathbf{100}_R$, a difference between the length $L_P$ of the locking projections $\mathbf{84}_1$-$\mathbf{84}_P$ and the combined maximum thickness AB of the front and rear shell members 22, 24 may be no more than 5 mm, in some cases no more than 3 mm, in some cases no more than 2 mm, in some cases no more than 1 mm and in some cases even less (e.g., 0.5 mm).

With continued reference to FIG. 16, the width $W_P$ of a locking projection $\mathbf{84}_i$ is a distance spanned by that locking projection $\mathbf{84}_i$ along the pivot axis 93. In this embodiment, the width $W_P$ of the locking projection $\mathbf{84}_i$ may be relatively small. For instance, in some cases, the width $W_P$ of the locking projection $\mathbf{84}_i$ may be no more than 15 mm, in some cases no more than 10 mm, in some cases no more than 5 mm, in some cases no more than 3 mm, and in some cases even less (e.g., 1.5 mm).

In some embodiments, the width $W_P$ of the locking projection $\mathbf{84}_i$ may be significant relative to the length $L_P$ of the locking projection $\mathbf{84}_i$. For instance, in some cases, a ratio $W_P/L_P$ of the width $W_P$ of the locking projection $\mathbf{84}_i$ over the length $L_P$ of the locking projection $\mathbf{84}_i$ may be at least 0.5, in some cases at least 1, in some cases at least 1.5, in some cases at least 2, in some cases at least 3, and in some cases even more.

Figure 15:
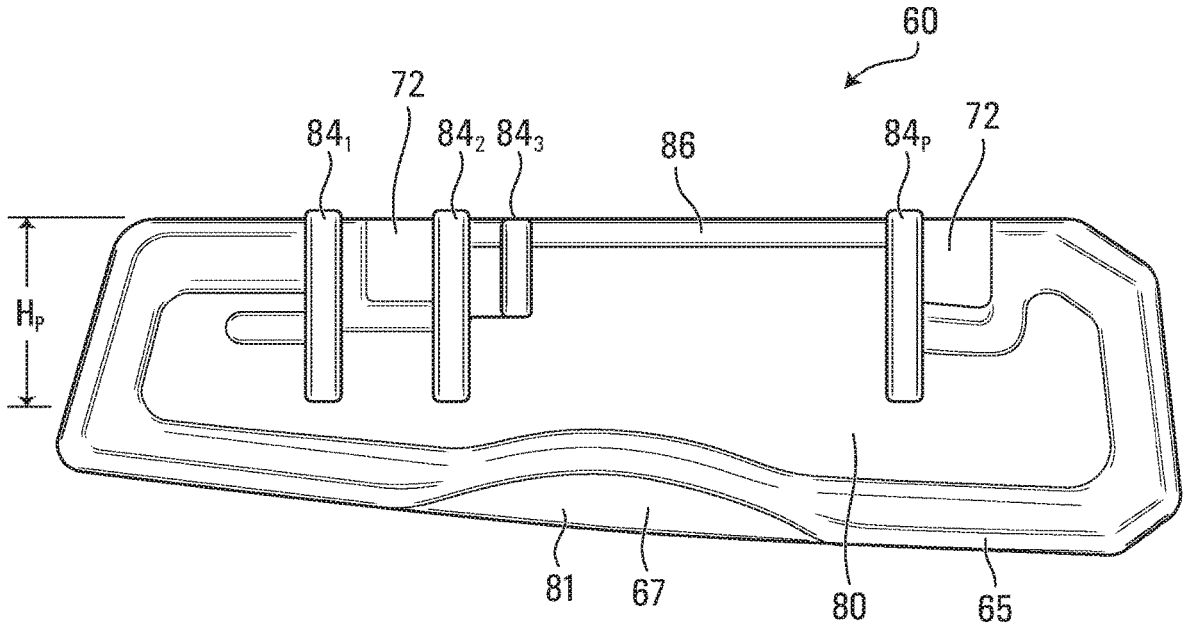
FIGS. 15, 16 and 17 are a rear, a top and a front elevation view of the actuator.

With reference to FIG. 15, the height $H_P$ of a given locking projection $\mathbf{84}_i$ is a distance spanned by that locking projection $\mathbf{84}_i$ in a direction from the upper edge 92 to the lower edge 89 of the actuator 60. In some cases, the height $H_P$ of the locking projection $\mathbf{84}_i$ may be no more than 20 mm, in some cases no more than 15 mm, in some cases no more than 10 mm, and in some cases no more than 5 mm, and in some cases even less (e.g., 3 mm).

In some embodiments, the height $H_P$ of the locking projection $\mathbf{84}_i$ may be significant relative to the length $L_P$ of the locking projection $\mathbf{84}_i$. For instance, in some cases, a ratio $H_P/L_P$ of the height $H_P$ of the locking projection $\mathbf{84}_i$ over the length $L_P$ of the locking projection $\mathbf{84}_i$ may be at least 2, in some cases at least 4, in some cases at least 6, in some cases at least 8, in some cases at least 10, and in some cases even more.

In this embodiment, the locking projections $\mathbf{84}_1$-$\mathbf{84}_P$ have a rectangular cross-section. As such, the locking projections $\mathbf{84}_1$-$\mathbf{84}_P$ may project like teeth from the actuator 60. Providing the locking projections $\mathbf{84}_1$-$\mathbf{84}_P$ with a tooth-like shape may enhance a tactile feedback a wearer may receive to indicate that the helmet 10 has acquired its maximum size, its minimum size or an intermediate size. Stated differently, providing the locking projections $\mathbf{84}_1$-$\mathbf{84}_P$ with a tooth-like shape may assist in signaling to the wearer that the locking projections $\mathbf{84}_1$-$\mathbf{84}_P$ have been received within corresponding ones of the locking recesses $100_1$-$100_R$. However, it should be understood that the locking projections $84_1$-$84_P$ may have any other suitable cross-sectional shape. For example, in some embodiments, the locking projections $84_1$-$84_P$ may have a circular cross-sectional shape or an oval cross-sectional shape.

Figure 10:
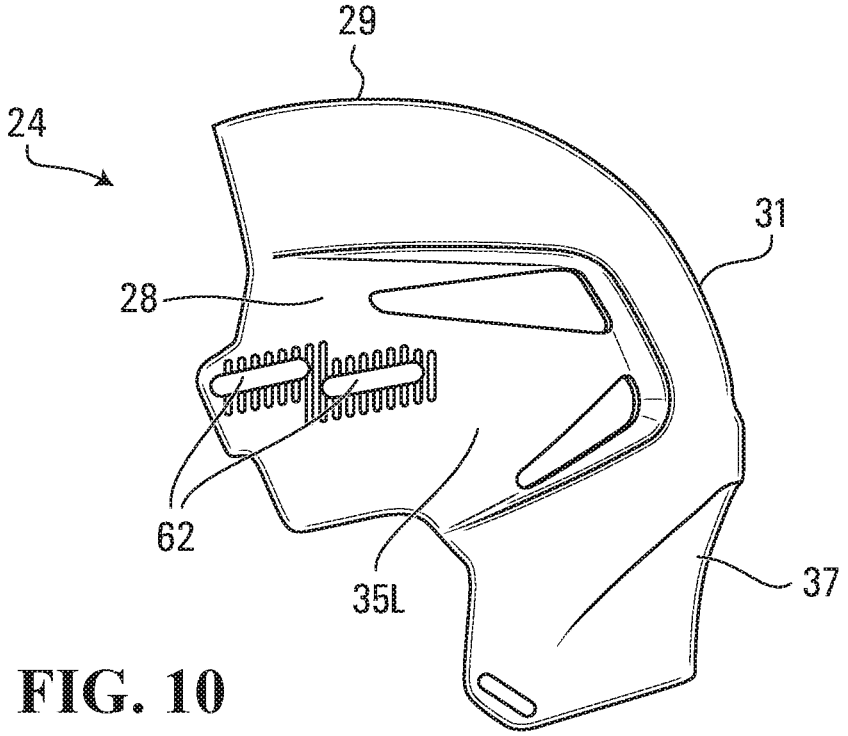

As shown in FIGS. 10 and 11, in this embodiment, the locking recesses $100_1$-$100_R$ are located on the rear shell member 24 at a position slightly above the wearer's ear in the vertical direction. (An opposite configuration is also envisaged whereby the locking recesses $100_1$-$100_R$ may be on the front shell member 22 while the openings $104_1$-$104_H$ aligned with the locking projections $84_1$-$84_P$ may be on the rear shell member 24.) Each of the locking recesses $100_1$-$100_R$ may have an internal profile configured to receive a respective one of the locking projections $84_1$-$84_P$. Moreover, the rear shell member 24 (or the front shell member 22) may comprise a number of locking recesses $100_1$-$100_R$ at least equal to the number of locking projections $84_1$-$84_P$. A greater number of locking recesses $100_1$-$100_R$ allows for a greater variety of relative positions of the front and rear shell members 22, 24. The distance (in the front-back direction of the helmet 10) between adjacent pairs of locking recesses $100_1$-$100_R$ may be constant (i.e., does not vary). In other instances, various groupings of the locking recesses $100_1$-$100_R$ may form sets for which the distance between adjacent locking recesses $100_1$-$100_R$ of the set may be the same as the distance between the corresponding locking projections $84_1$-$84_P$, whereby each such set represents a different helmet size.

In this embodiment, the locking recesses $100_1$-$110_R$ are "pocketed" in an outer surface 28 of the rear shell member 24 such that each locking recess $100_i$ constitutes a depression in the outer surface 28 of the rear shell member 24 but does not traverse an entirety of a thickness of the rear shell member 24. An extent of a given locking recess $100_i$ in the lateral direction of the helmet 10 may be referred to as a "depth" of the locking recess $100_i$. The depth of each locking recess $100_i$ is sufficient to receive a respective locking projection $84_i$ when the actuator 60 is in the closed position and is less than the maximum thickness of the rear shell member 24 in a vicinity of the locking recesses $100_1$-$100_R$. For instance, in some cases, the depth of the locking recesses $100_1$-$100_R$ may be no greater than 10 mm, in some cases no greater than 5 mm, in some cases no greater than 2 mm and in some cases even less (e.g., 0.5 mm)

Furthermore, in some cases, a difference between the maximum thickness B of the rear shell member 24 in the immediate vicinity of the locking recesses $100_1$-$100_R$ and the depth of the locking recesses $100_1$-$100_R$ may be no more than 5 mm, in some cases no more than 3 mm, in some cases no more than 1 mm and in some cases even less (e.g., 0.5 mm)

Furthermore, in some cases, a ratio of the depth of the locking recesses $100_1$-$100_R$ over the maximum thickness B of the rear shell member 24 in the vicinity of the locking recesses $100_1$-$100_R$ may be no more than 0.75, in some cases no more than 0.5, in some cases no more than 0.25, and in some cases even less (e.g., 0.1).

In other embodiments, the locking recesses $100_1$-$100_R$ may constitute openings that traverse the thickness of the rear shell member 24, even though the locking projections $84_1$-$84_P$ themselves do not project far enough within the locking recesses $100_1$-$100_R$ to reach the inner surface 17 of the outer shell 12. In such embodiments, the ratio of the depth of the locking recesses $100_1$-$100_R$ over the maximum thickness B of the rear shell member 24 in the vicinity of the locking recesses $100_1$-$100_R$ is 1.

In use, the actuator 60 may be raised out of, or lowered into, the recessed region 61 of the front shell member 22. When the actuator 60 sits within the recessed region 61 of the front shell member 22 (i.e., when the actuator 60 is in the closed position), the actuator plate 80 rests predominantly vertically, with the cam post 82 and the locking projections $84_1$-$84_P$ extending in the lateral direction towards an inside of the cavity 13 of the helmet 10. When the actuator 60 is in this closed position, the outer face 83 of the actuator plate 80 may follow the general smooth curvature of an exterior of the outer shell 12 and the locking projections $84_1$-$84_P$ may be hidden from view.

The adjustment mechanism 40 allows the actuator 60 to be swung from the closed position to the open position when a rotational force is applied to the actuator 60. Such a rotational force may be created by applying a force on the actuator plate 80 (e.g.: on the inner face 81) in the lateral direction away from the helmet 10. In this embodiment, in order to facilitate access to the inner face 81 of the actuator plate 80 when the actuator 60 is in the closed position, the outer shell 12 may comprise an indentation 95 located on a periphery of the recessed region 61 adjacent the bottom edge 89 of the actuator 60. Moreover, the actuator 60 itself may be configured to facilitate access to the inner face 81 of the actuator plate 80 when the actuator 60 is in the dosed position. More specifically, in this example of implementation, a periphery 65 of the actuator plate 80 comprises a recessed portion 67 adjacent its bottom edge 89 where the actuator plate 80 is relatively thin such that the wearer of the helmet can more easily insert his/her finger between the actuator 60 and the front shell member 22.

With the actuator 60 of the adjustment mechanism 40 having been raised out of the recessed region 61 of the front shell member 22 by a user, the actuator 60 acquires the open position, and the actuator plate 80 is disposed predominantly horizontally with the cam post 82 and locking projections $84_1$-$84_P$ extending vertically downwards. It is noted that when the actuator 60 is in the open position, the locking projections $84_1$-$84_P$ may be visible from an exterior of the helmet 10.

When the actuator 60 is placed in the open position, the locking projections $84_1$-$84_P$ have been removed from engagement with the locking recesses $100_1$-$100_R$ and the front shell member 22 and the rear shell member 24 are free to slide relative to one another along the direction of the channels 62 of the rear shell member 24. The wearer may therefore slide the front shell member 22 and the rear shell member 24 relative to one another so as to adjust the size of the helmet 10.

Once a desired size of the helmet 10 has been selected, the actuator 60 may be swung from the open position back into the closed position, thereby causing the locking projections $84_1$-$84_P$ (which project away from the inner face 81 of the actuator plate 80) to pass through the openings $104_1$-$104_H$ of the front shell member 22 and be received in the locking recesses $100_1$-$100_R$ of the rear shell member 24 without extending through the rear shell member 24. Some slight fine tuning of the size of the helmet 10 while closing the actuator 60 may be performed until tactile feedback has been received that the locking projections $84_1$-$84_P$ have indeed engaged with corresponding ones of the locking recesses $100_1$-$100_R$. With the locking projections $84_1$-$84_P$ passing through the openings $104_1$-$104_H$ and resting in the locking recesses $100_1$-$100_R$, motion of the rear shell member 24 relative to the front shell member 22 is precluded.

The cam surfaces 86, 88 may exert a threshold resistance on the outer surface 27 of the front shell member 22 against which a minimum rotational force must be applied to swing the actuator 60 between the closed and open positions, and vice versa. The cam surfaces 86, 88 may therefore prevent accidental rotation of the actuator 60 from one position to the other position without the necessary rotational force being applied to the actuator 60. Thus, for example, the cam surfaces 86, 88 may cause the actuator 60 to be maintained in the open position until a downward force is applied on the outside face 83 of the actuator plate 80 in order to place the actuator 60 in the closed position.

Furthermore, in this embodiment, the locking projections $\mathbf{84}_1$-$\mathbf{84}_P$ may be considered to be part of the cam portion 85. In particular, in this embodiment, similarly to the cam surfaces 86, 88, the locking projections $\mathbf{84}_1$-$\mathbf{84}_P$ are configured to exert a threshold resistance on the outer surface 27 of the front shell member 22 against which a minimum rotational force must be applied to swing the actuator 60 between the closed and open positions, and vice versa. For instance, in this example of implementation, a top surface 55 of a locking projection $\mathbf{84}_i$ may contact the outer surface 27 of the front shell member 22 when the actuator 60 is transitioning from its closed position to its open position and vice-versa such as to exert the threshold resistance on outer surface 27 of the front shell member 22.

In this embodiment, as shown in FIG. 7, the outer shell 12 also comprises a plurality of ventilation holes $\mathbf{39}_1$-$\mathbf{39}_V$ allowing air to circulate around the wearer's head 11 for added comfort. In this case, each of the front and rear shell members 22, 24 defines respective ones of the ventilation holes $\mathbf{39}_1$-$\mathbf{39}_V$ of the outer shell 12. Ventilation holes $\mathbf{39}_1$-$\mathbf{39}_V$ may provide the added comfort of allowing air to circulate around the wearer's head, thus permitting perspiration to evaporate.

Figure 20:
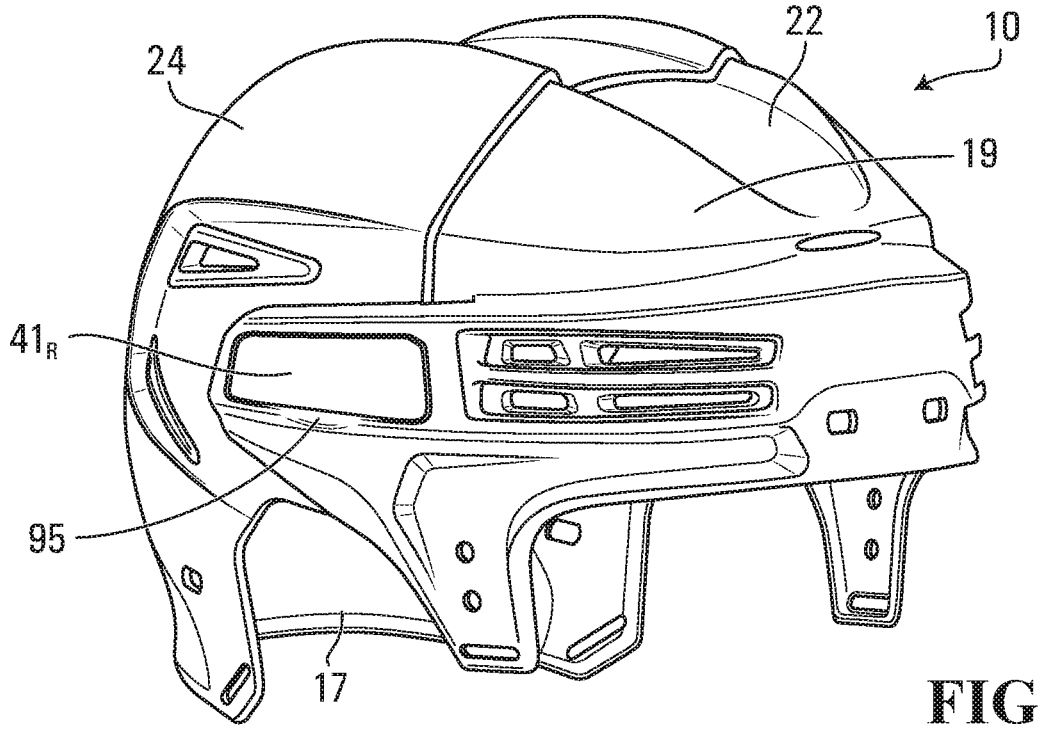
FIGS. 20 and 21 respectively show a perspective view of the helmet with the actuator of the adjustment element in a locked ("closed") position and an unlocked ("open") position.

With reference to FIG. 20, in this embodiment, the inner padding 15 is disposed between the outer shell 12 and the wearer's head 11 in use to absorb impact energy when the helmet 10 is impacted. More particularly, the inner padding 15 comprises a shock-absorbing structure 32 that includes an outer surface 38 facing towards the outer shell 12 and an inner surface 34 facing towards the wearer's head 11. In this embodiment, the shock-absorbing structure 32 comprises a plurality of pads $\mathbf{36}_1$-$\mathbf{36}_N$ to absorb impact energy. The pads $\mathbf{36}_1$-$\mathbf{36}_N$ are responsible for absorbing at least a bulk of the impact energy transmitted to the inner padding 15 when the helmet 10 is impacted and can therefore be referred to as "absorption" pads.

For example, in this embodiment, each of the pads $\mathbf{36}_1$-$\mathbf{36}_N$ comprises a shock-absorbing material 50. For instance, in some cases, the shock-absorbing material 50 may include a polymeric cellular material, such as a polymeric foam (e.g., expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material), or expanded polymeric microspheres (e.g., Expancel™ microspheres commercialized by Akzo Nobel). In some cases, the shock-absorbing material 50 may include an elastomeric material (e.g., a rubber such as styrene-butadiene rubber or any other suitable rubber; a polyurethane elastomer such as thermoplastic polyurethane (TPU); any other thermoplastic elastomer; etc.). In some cases, the shock-absorbing material 50 may include a fluid (e.g., a liquid or a gas), which may be contained within a container (e.g., a flexible bag, pouch or other envelope) or implemented as a gel (e.g., a polyurethane gel). Any other material with suitable impact energy absorption may be used in other embodiments. In other embodiments, a given one of the pads $\mathbf{36}_1$-$\mathbf{36}_N$ may comprise an arrangement (e.g., an array) of shock absorbers that are configured to deform when the helmet 10 is impacted. For instance, in some cases, the arrangement of shock absorbers may include an array of compressible cells that can compress when the helmet 10 is impacted. Examples of this are described in U.S. Pat. No. 7,677,538 and U.S. Patent Application Publication 2010/0258988, which are incorporated by reference herein.

In some embodiments, the shock-absorbing material 50 of different ones of the pads $\mathbf{36}_1$-$\mathbf{36}_N$ may be different. For instance, in some embodiments, the shock-absorbing material 50 of two, three, four or more the pads $\mathbf{36}_1$-$\mathbf{36}_N$ may be different. For example, in some embodiments, the shock-absorbing material 50 of a pad $\mathbf{36}_i$ may be different from the shock-absorbing material 50 of another pad $\mathbf{36}_j$. For instance, in some cases, the shock-absorbing material 50 of the pad $\mathbf{36}_i$ may be denser than the shock-absorbing material 50 of the pad $\mathbf{36}_j$. Alternatively or additionally, in some cases, the shock-absorbing material 50 of the pad $\mathbf{36}_i$ may be stiffer than the shock-absorbing material 50 of the pad $\mathbf{36}_j$. Combinations of different densities, thickness and type of material for the pads $\mathbf{36}_1$-$\mathbf{36}_N$ may permit for better absorption of high- and low-energy impacts.

The absorption pads $\mathbf{36}_1$-$\mathbf{36}_N$ may be present in any suitable number. For example, in some embodiments, the plurality of absorption pads $\mathbf{36}_1$-$\mathbf{36}_N$ may include at least three pads, in some cases at least five pads, in some cases at least eight pads, and in some cases even more pads (e.g., at least ten pads or more).

In addition to the absorption pads $\mathbf{36}_1$-$\mathbf{36}_N$, in this embodiment, the inner padding 15 comprises comfort pads $\mathbf{52}_1$-$\mathbf{52}_K$ which are configured to provide comfort to the wearer's head. In this embodiment, when the helmet 10 is worn, the comfort pads $\mathbf{52}_1$-$\mathbf{52}_K$ are disposed between the absorption pads $\mathbf{36}_1$-$\mathbf{36}_N$ and the wearer's head 11 to contact the wearer's head 11. The comfort pads $\mathbf{52}_1$-$\mathbf{52}_K$ may comprise any suitable soft material providing comfort to the wearer. For example, in some embodiments, the comfort pads $\mathbf{52}_1$-$\mathbf{52}_K$ may comprise polymeric foam such as polyvinyl chloride (PVC) foam, polyurethane foam (e.g., PORON XRD foam commercialized by Rogers Corporation), vinyl nitrile foam or any other suitable polymeric foam material. In some embodiments, given ones of the comfort pads $\mathbf{52}_1$-$\mathbf{52}_K$ may be secured (e.g., adhered, fastened, etc.) to respective ones of the absorption pads $\mathbf{36}_1$-$\mathbf{36}_N$. In other embodiments, given ones of the comfort pads $\mathbf{52}_1$-$\mathbf{52}_K$ may be mounted such that they are movable relative to the absorption pads $\mathbf{36}_1$-$\mathbf{36}_N$. For example, in some embodiments, given ones of the comfort pads $\mathbf{52}_1$-$\mathbf{52}_K$ may be part of a floating liner as described in U.S. Patent Application Publication 2013/10025032, which, for instance, may be implemented as the SUSPEND-TECH™ liner found in the BAUER™ RE-AKT™ and RE-AKT 100™ helmets made available by Bauer Hockey, Inc. The comfort pads $\mathbf{52}_1$-$\mathbf{52}_K$ may assist in absorption of energy from impacts, in particular, low-energy impacts.

The helmet 10 may further comprise protective padding 33 disposed between the outer shell 12 and the wearer's head 11 at a position slightly above the wearer's ear in the vertical direction corresponding to a position of a respective one of the left and right adjustment elements $\mathbf{41}_L$, $\mathbf{41}_R$ of the adjustment mechanism 40. The protective padding 33 may comprise the shock-absorbing structure 32 and/or the comfort pads 52. Due to the relatively short length $L_P$ of the locking projections $\mathbf{84}_1$-$\mathbf{84}_P$ by virtue of which the locking projections $84_1$-$84_P$ do not pass through the rear shell member 24, more free space may be provided between the wearer's head and the outer shell 12 than in scenarios in which locking projections of a similar adjustment system were to extend through both the front and rear shell members 22, 24. This "free space" may allow the protective padding 33 to occupy more space in the lateral direction of the helmet 10. This may in turn improve the protection provided by the protective padding 33 thus rendering the helmet 10 safer. For instance, in some cases, a thickness of the protective padding 33 may be at least 5 mm, in some cases at least 15 mm, in some cases at least 20 mm, in some cases at least 30 mm, in some cases at least 40 mm, in some cases at least 50 mm, and in some cases even more. Moreover, in some cases, a ratio of the thickness of the protective padding 33 over the width W of the helmet 10 may be at least 0.01, in some cases at least 0.05, in some cases at least 0.1, in some cases at least 0.15, in some cases at least 0.2 and in some cases even more Any feature of any embodiment discussed herein may be combined with any feature of any other embodiment discussed herein in some examples of implementation.

Although in embodiments considered above the helmet 10 is a hockey helmet for protecting the head of a hockey player, in other embodiments, a helmet constructed using principles described herein in respect of the helmet 10 may be another type of sport helmet. For instance, a helmet constructed using principles described herein in respect of the helmet 10 may be for protecting the head of a player of another type of contact sport (sometimes referred to as "full-contact sport" or "collision sport") in which there are significant impact forces on the player due to player-to-player and/or player-to-object contact. For example, in one embodiment, a helmet constructed using principles described herein in respect of the helmet 10 may be a lacrosse helmet for protecting the head of a lacrosse player. As another example, in one embodiment, a helmet constructed using principles described herein in respect of the helmet 10 may be a football helmet for protecting the head of a football player. As another example, in one embodiment, a helmet constructed using principles described herein in respect of the helmet 10 may be a baseball helmet for protecting the head of a baseball player (e.g., a batter or catcher). Furthermore, a helmet constructed using principles described herein in respect of the helmet 10 may be for protecting the head of a wearer involved in a sport other than a contact sport (e.g., bicycling, skiing, snowboarding, horseback riding or another equestrian activity, etc.).

Also, while in the embodiments considered above the helmet 10 is a sport helmet, a helmet constructed using principles described herein in respect of the helmet 10 may be used in an activity other than sport in which protection against head injury is desired. For example, in one embodiment, a helmet constructed using principles described herein in respect of the helmet 10 may be a motorcycle helmet for protecting the head of a wearer riding a motorcycle. As another example, in one embodiment, a helmet constructed using principles described herein in respect of the helmet 10 may be an industrial or military helmet for protecting the head of a wearer in an industrial or military application.

In case of any discrepancy, inconsistency, or other difference between terms used herein and terms used in any document incorporated by reference herein, meanings of the terms used herein are to prevail and be used.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A helmet for protecting a wearer's head, the helmet comprising:

a) an outer shell comprising a first shell member and a second shell member movable relative to one another in a longitudinal direction of the helmet to adjust a size of a cavity for receiving the wearer's head;

b) an adjustment mechanism configured to control movement of the first shell member and the second shell member relative to one another, the adjustment mechanism comprising:

i) an actuator movable between a first position in which the first shell member and the second shell member are allowed to move relative to one another and a second position in which the first shell member and the second shell member are precluded from moving relative to one another;

ii) two points of attachment between the first shell member and the second shell member, the two points of attachment configured to interconnect the first shell member and the second shell member while allowing the first shell member and the second shell member to move relative to one another when the actuator is in the first position; and iii) a locking recess on an outer surface of the second shell member;

the actuator comprising a locking projection configured such that, when the cavity is of a first size and the actuator is in the second position, the locking projection extends through the first shell member at a point located between the two points of attachment interconnecting the first shell member and the second shell member and is received by the locking recess to lock the first shell member and the second shell member relative to one another without extending through the second shell member, wherein the locking projection is a first locking projection, the actuator comprising a plurality of locking projections, inclusive of the first locking projection, that extend through the first shell member when the actuator is in the second position, wherein each locking projection of the plurality of locking projections projects away from an inner face of the actuator and is disposed between the two points of attachment interconnecting the first shell member and the second shell member at a different location along the longitudinal direction of the helmet, wherein adjacent ones of the plurality of locking projections are joined at upper ends thereof by a surface that projects away from the inner face of the actuator and extends between the adjacent locking projections in the longitudinal direction of the helmet.

2. The helmet of claim 1, wherein the plurality of locking projections of the actuator comprises at least three parallel locking projections.

3. The helmet of claim 2, wherein the locking projections are evenly spaced from one another.

4. The helmet of claim 1, wherein the second shell member comprises a plurality of locking recesses configured to receive the locking projections.

5. The helmet of claim 1, wherein a ratio of (i) a distance by which the first locking projection protrudes into the outer shell when the actuator is in the second position to (ii) a width of the helmet is no more than 1:50.

6. The helmet of claim 1, wherein a distance by which the first locking projection protrudes into the outer shell when the actuator is in the second position is no more than 15 millimeters (mm).

7. The helmet of claim 1, wherein, when the actuator is in the second position, the first locking projection is hidden from view.

8. The helmet of claim 7, wherein, when the actuator is in the first position, the first locking projection is visible from an exterior of the helmet.

9. The helmet of claim 1, wherein the helmet comprises protective padding facing an internal surface of the outer shell, wherein a thickness of a portion of the protective padding in an area of the helmet opposite the actuator when the actuator is in the second position is at least 5 mm.

10. The helmet of claim 9, wherein a ratio of (i) a thickness of a portion of the protective padding opposite to the actuator when the actuator is in the second position and (ii) a width of the helmet is at least 0.1.

11. The helmet of claim 1, wherein:

the actuator is a first actuator located on a first side of the helmet;

the two points of attachment between the first shell member and the second shell member are a first two points of attachment located on the first side of the helmet;

the locking recess is a first locking recess on the outer surface of the second shell member on the first side of the helmet, the first two points of attachment configured to interconnect the first shell member and the second shell member and allow the first shell member and the second shell member to move relative to one another when the first actuator is in the first position; and the adjustment mechanism further comprises:

i) a second actuator located on a second side of the helmet and movable between a first position in which the first shell member and the second shell member are allowed to move relative to one another and a second position in which the first shell member and the second shell member are precluded from moving relative to one another;

ii) a second two points of attachment between the first shell member and the second shell member on the second side of the helmet, the second two points of attachment configured to interconnect the first shell member and the second shell member and allow the first shell member and the second shell member to move relative to one another when the second actuator is in the first position; and iii) a second locking recess on the outer surface of the second shell member on the second side of the helmet;

the second actuator comprising a locking projection configured such that, when the cavity is of the first size and the second actuator is in the second position, the locking projection on the second actuator extends through the first shell member at a point located between the second two points of attachment interconnecting the first shell member and the second shell member on the second side of the helmet and is received by the second locking recess to lock the first shelf member and the second shell member relative to one another without extending through the second shell member.

12. The helmet of claim 1, wherein the actuator is pivotally mounted to the outer shell.

13. The helmet of claim 1, wherein the locking recess is pocketed in the outer surface of the second shell member.

14. The helmet of claim 1, wherein when the actuator is in the second position, the two points of attachment between the first shell member and the second shell member are covered by the actuator such that the two points of attachment are hidden from view by the actuator when the actuator is in the second position.

15. The helmet of claim 14, wherein the actuator is received in a recessed region of the first shell member when the actuator is in the second position, wherein the two points of attachment between the first shell member and the second shell member extend through openings in the first shell member located in the recessed region of the first shell member.

16. The helmet of claim 14 wherein when the actuator is in the first position, external end portions of the two points of attachment between the first shell member and the second shell member are visible.

17. The helmet of claim 1, wherein the locking projection remains fixed in relation to the two points of attachment between the first shell member and the second shell member when the size of the cavity is adjusted to different sizes.

18. A helmet for protecting a wearer's head, the helmet comprising:

a) an outer shell comprising a first shell member and a second shell member movable relative to one another in a longitudinal direction of the helmet to adjust a size of a cavity for receiving the wearer's head;

b) an adjustment mechanism configured to control movement of the first shell member and the second shell member relative to one another, the adjustment mechanism comprising:

i) an actuator movable between a first position in which the first shell member and the second shell member are allowed to move relative to one another and a second position in which the first shell member and the second shell member are precluded from moving relative to one another;

ii) two points of attachment between the first shell member and the second shell member, the two points of attachment configured to interconnect the first shell member and the second shell member while allowing the first shell member and the second shell member to move relative to one another when the actuator is in the first position; and iii) a locking recess on an outer surface of the second shell member;

the actuator comprising a locking projection configured such that, when the cavity is of a first size and the actuator is in the second position, the locking projection extends through the first shell member at a point located between the two points of attachment interconnecting the first shell member and the second shell member and is received by the locking recess to lock the first shell member and the second shell member relative to one another without extending through the second shell member, wherein the locking projection is a first locking projection, the actuator comprising a plurality of locking projections, inclusive of the first locking projection, that extend through the first shell member when the actuator is in the second position, wherein the plurality of locking projections comprises a second locking projection configured such that, when the cavity is of a second size and the actuator is in the second position, the second locking projection extends through the first shell member at a point located between the two points of attachment interconnecting the first shell member and the second shell member and is received by the locking recess to lock the first shell member and the second shell member relative to one another without extending through the second shell member, wherein the first and second locking projections are joined at upper ends thereof by a surface that projects away from the inner face of the actuator and extends between the first and second locking projections in the longitudinal direction of the helmet.

19. The helmet of claim 18, wherein when the actuator is in the second position, the two points of attachment between the first shell member and the second shell member are covered by the actuator such that the two points of attachment are hidden from view by the actuator when the actuator is in the second position.

20. The helmet of claim 19, wherein the actuator is received in a recessed region of the first shell member when the actuator is in the second position, wherein the two points of attachment between the first shell member and the second shell member extend through openings in the first shell member located in the recessed region of the first shell member.

21. The helmet of claim 19 wherein when the actuator is in the first position, external end portions of the two points of attachment between the first shell member and the second shell member are visible.

* * * * *